US011950626B2

(12) United States Patent
Simpson et al.

(10) Patent No.: US 11,950,626 B2
(45) Date of Patent: Apr. 9, 2024

(54) FLOWER CARTRIDGE CRIMPING AND FILLING FOR HERB DELIVERY

(71) Applicant: Swisher International, Inc., Jacksonville, FL (US)

(72) Inventors: Michael Lee Simpson, Santa Monica, CA (US); Matthew James Bickerton, Topanga, CA (US)

(73) Assignee: SWISHER INTERNATIONAL, INC., Jacksonville, FL (US)

( * ) Notice: Subject to any disclaimer, the term of this patent is extended or adjusted under 35 U.S.C. 154(b) by 139 days.

(21) Appl. No.: 16/509,469

(22) Filed: Jul. 11, 2019

(65) Prior Publication Data

US 2020/0015516 A1 Jan. 16, 2020

Related U.S. Application Data

(60) Provisional application No. 62/836,641, filed on Apr. 20, 2019, provisional application No. 62/696,765, filed on Jul. 11, 2018.

(51) Int. Cl.
*A24D 3/06* (2006.01)
*A24C 5/01* (2020.01)
(Continued)

(52) U.S. Cl.
CPC ..... *A24D 3/061* (2013.01); *A24C 5/01* (2020.01); *A24D 1/02* (2013.01); *A24D 1/20* (2020.01);
(Continued)

(58) Field of Classification Search
CPC ..... A24F 40/10; A24F 40/40; A24F 40/46; A24F 40/485; A24F 47/00; A24F 47/008
See application file for complete search history.

(56) References Cited

U.S. PATENT DOCUMENTS 910,977 A * 1/1909 Weiss ..... B30B 9/00 53/529
4,793,365 A * 12/1988 Sensabaugh, Jr. ..... A24D 1/22 131/194
(Continued)

FOREIGN PATENT DOCUMENTS

CA 3017429 A1 12/2017
CN 201767029 U 3/2011
(Continued)

OTHER PUBLICATIONS

Buddies Brand, "Buddies Bump Box Filler for King Size—Fills 76 Cones Simultaneously", https://www.amazon.com/Buddies-Bump-Filler-King-Size/dp/B07BWWWCG9?th=1, Accessed Feb. 7, 2022. Product first available Apr. 3, 2018. (Year: 2018).*
(Continued)

*Primary Examiner* — Michael H. Wilson
*Assistant Examiner* — Stephanie Lynn Moore
(74) *Attorney, Agent, or Firm* — LUCAS & MERCANTI, LLP

(57) ABSTRACT

A filling method and process for a flower cartridge for use with a portable electronic heating device for the smokeless delivery of active ingredients and volatile compounds released from heating natural consumables such as plant matter is disclosed. Through grinding, vibration, and tamping, a number of cartridges are filled with natural consumables. Compressive forces applied via tamping, coupled with a constriction or obstruction within the cartridge, form a porous plug to which air flows freely but the consumables remain in place. The filling process minimizes oxidation and preserves the shelf life of the flower cartridge.

23 Claims, 37 Drawing Sheets

(51) Int. Cl.

| | |
|---|---|
| ***A24D 1/02*** | (2006.01) |
| ***A24D 1/14*** | (2006.01) |
| ***A24D 1/20*** | (2020.01) |
| ***A24D 3/02*** | (2006.01) |
| ***A24F 15/01*** | (2020.01) |
| ***A24F 40/20*** | (2020.01) |
| ***A24F 40/70*** | (2020.01) |

(52) U.S. Cl.
CPC ..... *A24F 40/20* (2020.01); *A24F 40/70* (2020.01); *A24D 1/14* (2013.01); *A24D 3/027* (2013.01); *A24D 3/0279* (2013.01); *A24D 3/0295* (2013.01); *A24F 15/01* (2020.01)

(56) References Cited

U.S. PATENT DOCUMENTS

| | | | | |
|---|---|---|---|---|
| 2010/0269839 | A1* | 10/2010 | Kaljura | A24D 1/006 131/58 |
| 2011/0058924 | A1* | 3/2011 | Sikora | A24C 5/356 414/403 |
| 2016/0120212 | A1* | 5/2016 | Heidtmann | A24C 5/02 131/70 |
| 2017/0340003 | A1 | 11/2017 | Batista et al. | |
| 2018/0303159 | A1* | 10/2018 | Ghiotti | A24D 1/22 |
| 2019/0150501 | A1* | 5/2019 | Duffy | F23Q 2/50 |

FOREIGN PATENT DOCUMENTS

| | | | | |
|---|---|---|---|---|
| CN | 201789924 | U | 4/2011 | |
| CN | 203087525 | U | 7/2013 | |
| CN | 109069776 | A | 12/2018 | |
| EP | 3175722 | A1 | 6/2017 | |
| EP | 3463534 | A1 | 4/2019 | |
| JP | 2019521667 | A | 8/2019 | |
| KR | 1020190012159 | A | 2/2019 | |
| MX | 20180144450 | A | 4/2019 | |
| WO | WO-2017172844 | A1 * | 10/2017 | A24D 1/18 |
| WO | 2017207416 | A1 | 12/2017 | |
| WO | 2020014550 | | 1/2020 | |
| WO | 2020014550 | A2 | 1/2020 | |
| WO | 2020014550 | A3 | 2/2020 | |
| WO | 2020014550 | A4 | 4/2020 | |

OTHER PUBLICATIONS

International Searching Authority, PCT/US2019/041499, RO/210 Form, International Search Report, dated Jan. 13, 2020.

International Searching Authority, PCT/US2019/041499, RO/237, Written Opinion of the International Search Authority, dated Jan. 13, 2020.

* cited by examiner

FIG.6B (CROSS SECTION)

FIG.6H (CROSS SECTION)

FLOWER CARTRIDGE CRIMPING AND FILLING FOR HERB DELIVERY

CROSS-REFERENCE TO RELATED APPLICATIONS

This application claims benefit of priority to prior-filed U.S. Applications 62/696,765 filed Jul. 11, 2018 and 62/836,641 filed Apr. 20, 2019, of which the entire contents thereof are hereby incorporated by reference into the present disclosure.

BACKGROUND OF THE INVENTION

The present invention relates generally to a disposable flower cartridge that facilitates the smokeless delivery of active ingredients and volatile compounds released from a quantity of natural consumables that have been pre-filled in the cartridge. A heating device is used to vaporize the natural consumables in the cartridge by convective heating of ambient air, thereby releasing volatile compounds at specified temperature profiles. The cartridge also serves as a mouthpiece through which the user inhales the chemicals from the vaporized natural consumables.

A cartridge dispenses a consistent amount of natural consumables, which comprise ground flower and plant matter. Such a cartridge may dispense an accurate dosage of natural consumables for predictable and measured enjoyment by the user. A cartridge containing natural consumables in the form of ground flower or plant matter may allow the extraction and delivery of active ingredients and volatile compounds.

Traditionally, smokers relied on combustion of natural consumables in the form of cigarettes or other assistive devices to inhale the active ingredients. The present invention relies on heat-not-burn technology, wherein instead of burning, mere heating is applied. A cartridge pre-filled with natural consumables obviates the need to separately load the natural consumables into a heating or burning device by the user, nor is there any requirement to rely on ignition sources.

The fabrication materials of the cartridge are non-combustible within the normal operating range of the heating device nor at the vaporization temperatures of the active ingredients, such that the cartridge and the natural consumables may be heated to various temperatures for the extraction of desired chemicals by the convective transfer of heated air, not combustion. The "smokeless" feature of a cartridge can help mitigate the deleterious health effects associated with smoking.

The construction of the cartridge should be sufficiently strong to maintain a desired shape in response to crimping, lateral, compression, and compaction forces. The cartridge is also configured to minimize physical contact between the natural consumable and the oven in the heating device. This feature may mitigate the need to clean or otherwise maintain the oven. To achieve these goals, the cartridge is filled by compression where the natural consumables retain their shape and do not fall out of the cartridge throughout the lifecycle of the cartridge. The compressed natural consumables, in conjunction with stopper-type obstructions, form a porous plug where air passes relatively freely yet the plug remains stationary throughout the lifecycle of the cartridge. It is also desirable that the cartridge be disposable, biodegradable, and made out of mainly plant matter to reduce ecological impact.

Accordingly, there is a need in the art for an improved cartridge for use with a novel portable convective heating device for the delivery of vaporized natural consumables, and for the manufacturing and filling of such cartridges and devices.

BRIEF SUMMARY OF THE INVENTION

According to an aspect of the present invention, there is provided a cartridge for use with an electronically portable convective heating device for the delivery of vaporized natural consumables. The cartridge includes a first tube having openings at a mouthpiece end and an insertion end. The cartridge is sized and configured such that the insertion end is insertable into the heating device. The cartridge also includes a first cavity inside the first tube defining a longitudinal axis and a lateral axis disposed perpendicular to the longitudinal axis, in addition to the cartridge has a second tube having openings at a junction end and a stopper end. The second tube is sized and configured to be insertable into the first cavity of the first tube. Upon insertion of the second tube into the first tube, the junction end of the second tube is proximate to the mouthpiece end of the first tube. The second tube has a second cavity defining a longitudinal axis and a lateral axis disposed perpendicular to the longitudinal axis. The second cavity extends towards the mouthpiece end of the first tube.

In one embodiment, the first cavity of the first tube is fillable with natural consumables between the insertion end of the first tube and the stopper end of the second tube. The stopper end of the second tube is sized and configured to block the natural consumables from falling out of the stopper end. In another embodiment, upon insertion of the second tube into the first tube, the junction end of the second tube is proximate the insertion end of the first tube. In this embodiment, the second cavity of the first tube is fillable with natural consumables between the junction end of the second tube and the stopper end of the second tube. The second cavity extends towards the insertion end of the first tube. The stopper end of the second tube is again sized and configured to block the natural consumables from falling out of the stopper end.

These novel configurations enable the passage by convection of heated air from the heating device into the cartridge. The heated air heats the natural consumables filled in the first or second cavities, thereby releasing a variety of vaporized cannabinoids, terpenes, and other volatile compounds at differing temperature profiles. The mouthpiece end of the cartridge serves as a mouthpiece through which the user inhales the desired chemicals.

An automated temperature profile enables the delivery of various compounds from the "whole plant" that could not otherwise be extracted by combustion or through the use of static temperature profiles. The first or second cavities in each cartridge are consistently dosed with a premeasured quantity of natural consumables that allows the user to anticipate the duration of the session and strength of the consumable that is inhaled. The pre-filling of the first or second tube allows the user to immediately enjoy the consumable without having to separately load it into the heating device. With the cartridge configured such that the consumable is maintained in the first or second tube, there is minimal physical contact between the consumable and the oven surface of the heating device. This advantageously mitigates the need to clean or otherwise maintain the oven from debris or residue left by the consumable. The minimal contact between the consumable and the oven surface also reduces the likelihood that the consumable will combust, because the consumable's "contact" temperature is within the range enabled by the convective movement of hot air rather than that transferred on a heated surface.

In yet further embodiments, the first and second tube may have a rigid wall construction made of one or more of the following materials: bonded, folded, rolled, extruded, and/or molded paper, plastic, or metal. The first tube and the second may be formed of layers of rolled paper treated with an adhesive such as polyvinyl acetate (PVAc). High-temperature silicone adhesives, PVA, high-temperature epoxy adhesives, cellulose glue, natural rubber, or starch glue may also be used. No-glue, ceramic, or non-porous woven or non-woven materials are contemplated. Other methods of tube construction known in the art are contemplated so as to achieve sufficient rigidity in the first tube and the second tube to maintain a desired shape.

According to yet further embodiments, the insertion end of the first tube is accomplished by a tolerance fit into the heating device. It is desirable for the first tube to maintain its shape when it is subject to the lateral and compression forces caused by the tolerance fit with the heating device.

In another embodiment, the second tube is inserted by interference or compression fit into the first tube. In these embodiments, the natural consumables filled in the first or second cavity exert lateral forces against the interior of the first or second tube, respectively. The compressed natural consumable form a porous plug and immobilizes the second tube within the first tube. As discussed above, it is desirable for the first tube and the second tube to maintain their shape upon being subject to the forces caused by their interference fit.

The first tube and the second tube are made of non-combustible materials at contemplated operating temperatures. This feature enables the heating of the natural consumables filled in the first or second cavity to the temperatures necessary for the extraction of desirable cannabinoids, terpenes, and other volatile compounds. This uniquely allows the cartridge to withstand the temperatures associated with the convective transfer of heated air from the heating device into the cartridge without combusting. The "smokeless" feature of a system using the cartridge with the heating device can help mitigate the deleterious health effects caused by smoking. In other embodiments, the flower cartridge may be used with a non-convective heating device, such as one that operates by conduction.

The stopper end of the second tube may be crimped into various shapes to help prevent the consumables from falling out of the second tube. According to one embodiment, the stopper end of the second tube may be crimped to take the shape of a four-pointed star. In yet further embodiments, the stopper end may take the shape of other configurations, including but not limited to variations of a circle, a triangle, a five-pointed star, a crescent, a heart, a figure-8, an "s"-shape, a rectangle, a three-pointed star, a square, a three-leafed clover, a four-leaved clover, an oval, a cross, a pentagon, a four-sided polygon, a five-sided polygon, and a polygon with more than five sides.

In other embodiments, the second tube may be crimped at some point between the junction end and the stopper end. The resultant shape may assume various configurations, including but not limited to a three-pointed star, a four-pointed star, a circle, a spiral circle, or some other shape. In yet another embodiment, a cartridge may be formed with just a single tube that is crimped at some point between the junction end and the stopper end.

In yet further cartridge embodiments, the stopper end of the second tube has a size and given shape that is configured to block natural consumables from falling out of the stopper end.

The foregoing shapes formed by crimping of the stopper end and/or other portion of the second tube are given by way of example only and not limitation to only those embodiments specifically disclosed herein. Given the above disclosures, one skilled in the art could devise other variations of a three, four, five or other multi-sided polygon, oval, circle, triangle, or other shape that are within the scope and spirit of the invention disclosed herein.

According to another embodiment of the present invention, the cartridge may be comprised of a single tube having openings at a mouthpiece end and an insertion end. The cartridge may be sized and configured such that the insertion end may be insertable into the heating device. The tube may further include a cavity defining a longitudinal axis and a lateral axis disposed perpendicular to the longitudinal axis. The cavity may be fillable with natural consumables. Also, the cartridge may have a stopper insert sized and configured to be disposable into the cavity proximate the mouthpiece end. The stopper insert may be sized and configured to block the natural consumables from falling out of the mouthpiece end while still permitting the vaporized cannabinoids and terpenes that have been heated by convection to flow to the mouthpiece end and be inhaled by the user. The stopper insert is positioned in a compressed configuration when placed within the single tube.

Blocking by inserting any object that has a diameter slightly larger than the tube is expressly contemplated. Such object may be made of paper, metal, plastic, ceramic, wood, or textile. It may be in disk, bead, jack, star, or ball shapes. Such an object may also be paper folded longitudinally, adapted to have a slightly larger diameter than the tube when unconstructed, folded into a W, S, N, or other shape.

The foregoing stopper insert shapes, material, and configurations able to prevent "whole plant" from falling out of the tube while still permitting vapor to flow to the mouthpiece end are given by way of example only and not limitation to only those embodiments specifically disclosed herein. Given the above disclosures, one skilled in the art could devise other variations of a stopper that are within the scope and spirit of the invention disclosed herein.

In yet a further embodiment, the cartridge may be comprised of a single tube having openings at a mouthpiece end and an insertion end insertable into the heating device. The cartridge may also have an obstruction structurally positioned in the single tube between the mouthpiece end and the insertion end. The obstruction may be formed by a crimp around the circumference of the tube.

Also, another cartridge embodiment may include a single tube formed by rolling paper. The single tube may have openings at a mouthpiece end and an insertion end insertable into the heating device. This embodiment may also have an obstruction structurally positioned in the single tube between the mouthpiece end and the insertion end. The obstruction comprises the rolling paper, with such paper being folded or twisted within the single tube. In this configuration, a first cavity is defined by the mouthpiece end and the obstruction. A second cavity is defined by the insertion end and the obstruction. The second cavity may be fillable with natural consumables.

In another exemplary embodiment, the crimping and formation of the second tube of a flower cartridge is disclosed. The second tube is arranged vertically within a base plate and a crimping die plate, of which individual dies are formed within the holes of the die plate, is pressed into the standing tubes.

Also disclosed is the filling process by which natural consumables are filled into the flower cartridge to achieve uniform weight and characteristics. Cartridges are loaded into a cartridge tray assembly, which is further placed into a filling assembly. Consumables are spread out on the tray and physically manipulated to drop into individual cartridges and compacted via vibration means. The filling assembly is then inserted into a press and tamped so that the natural consumables, having been packed tightly, will be immobilized in the cartridge by way of friction.

The heating device operates based on passing heated air through the flower cartridge in what is known as heat-not-burn technology. The temperature of the oven and consequently the air is controlled electronically according to a temperature profile, which is defined by preset temperatures at certain times of a smoking session. Such a profile may raise the temperature quickly followed by a gradual decrease; raising the temperature quickly followed by holding the temperature; raising the temperature followed by a gradual decrease and raising the temperature again near the end of the session. The current fed to the oven is adjusted by sensor feedback. As the plant matter dries as it is heated, less energy is required to heat the air and requires a gradually decreasing temperatures of the oven.

BRIEF DESCRIPTION OF THE DRAWINGS

These and other features and advantages of the various embodiments disclosed herein will be better understood with respect to the following description and drawings, in which like numbers refer to like parts throughout, and in which:

FIG. 6B is a cross-sectional view of a stopper insert inserted into a single tube with consumables filled therein.

FIG. 6H is a cross-sectional view of a stopper insert inserted into a single tube with consumables filled therein.

FIG. 10E is a profile view of the major electronic components of the heating device as assembled.

FIG. 10F is a block diagram of the electronic logic of the heating device.

FIG. 10G is a graph of temperature vs. time showing an exemplary temperature profile.

FIG. 10H is a graph of a temperature profile overlaid with a power application graph.

FIG. 10J is a graph of another temperature profile overlaid with a power application graph.

FIG. 10K is a graph of another temperature profile overlaid with a power application graph.

DETAILED DESCRIPTION

The drawings referred to herein are for the purpose of illustrating the preferred embodiments of the present invention and not for the purpose of limiting the same.

Figure 1A:
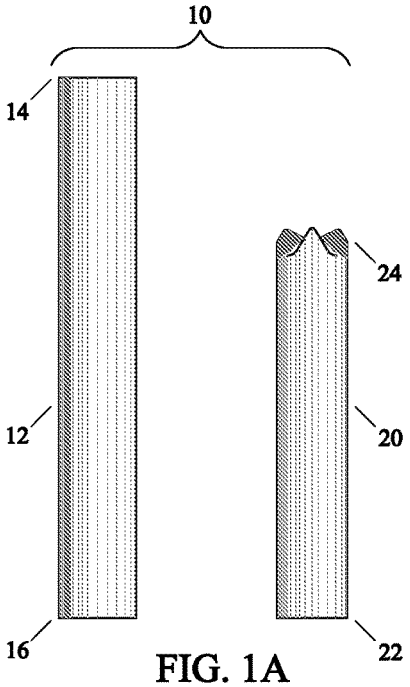
FIG. 1A is a profile view of an embodiment of a cartridge having a first tube and a second tube.
Figure 1B:
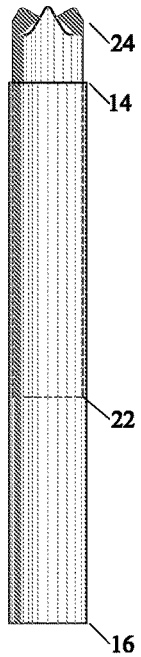
FIG. 1B is a profile view of an embodiment of a cartridge with the second tube partially inserted into the first tube.
Figure 1X:
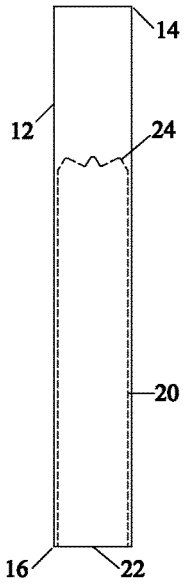
FIG. 1X is an outline view of an embodiment of a cartridge disposed in its final configuration before the filling process.
Figure 1C:
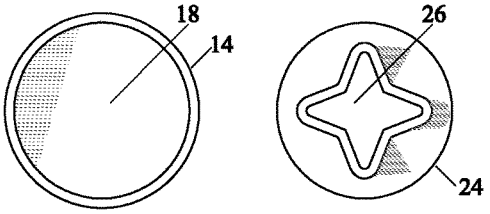
FIG. 1C is a top view of an embodiment of a cartridge with a first tube and a second tube.

FIGS. 1A and 1C are drawings of the flower cartridge 10 having a first tube 12 and a second tube 20. In this embodiment, both the first tube 12 and the second tube 20 are substantially cylindrical. The first tube 12 has openings at a mouthpiece end 16 and an insertion end 14. The second tube 20 has openings at a junction end 22 and a stopper end 24. In an embodiment of the cartridge 10 as shown for example in FIG. 1B, the diameter of the second tube 20 is less than the diameter of the first tube 12 such that the second tube 20 is insertable into a first cavity 18 of the first tube 12. The second tube 20 is partially inserted into the first tube 12 as shown in FIG. 1B by interference fit, with compression forces immobilizing the second tube 20 within the first tube 12. In the embodiment of the cartridge 10 depicted in FIGS. 1B and 1F, the junction end 22 of the second tube 20 is proximate to the mouthpiece end 16 of the first tube 12 when the second tube 20 has been completely inserted by interference fit into the first cavity 18 of the first tube 12. The insertion end 14 of the first tube 12 is insertable by tolerance fit into the heating device 42, as shown in FIGS. 10C and 10D. In the embodiment shown in FIGS. 1B and 1F, the second cavity 26 extends towards the mouthpiece end 16 of the first tube 12. The first cavity 18 of the first tube 12 is filled with natural consumables 44 between the insertion end 14 of the first tube 12 and the stopper end 24 of the second tube 20.

It is noted that the none of the cavities 18 or 26 restrict air movement caused by drawing a breath even when filled with natural consumables 44 and that the stopper end is intended to immobilize natural consumables only and not restrict air flow, and consequently the movement of active ingredients and volatile compounds. Natural consumables 44 comprise herbs used for smoking, such as ground cannabis flower and plant matter, hemp, tobacco, or other smoke-able plant matter.

Figure 1D:
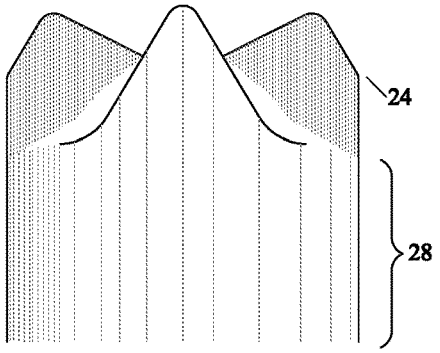
FIG. 1D is an exploded profile view of an embodiment of a cartridge showing the stopper end of a second tube.
Figure 1E:
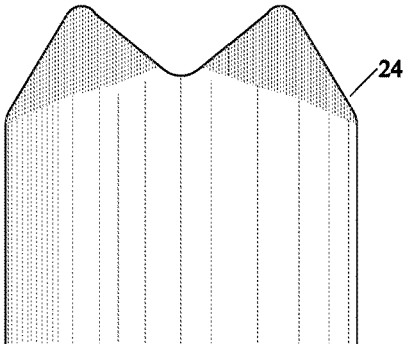
FIG. 1E is an exploded profile view of an embodiment of a cartridge showing the stopper end of a second tube.
Figure 1F:
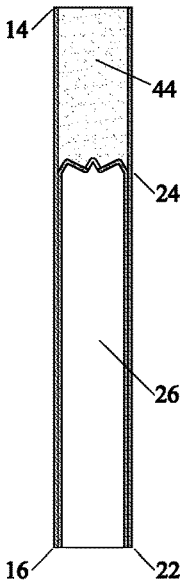
FIG. 1F is a cross-sectional view of an embodiment of a cartridge showing the cartridge with consumables filled therein.

FIG. 1X and FIG. 1F show the cartridge in its final configuration. FIG. 1X shows the second tube (in outline) completely disposed within the first tube where the junction end of the second tube is flush with the mouthpiece end of the first tube. FIG. 1F shows how the stopper end 24 is sized and configured to block the natural consumables 44 from falling out of the stopper end 24 and into the second cavity 26. In this embodiment, the natural consumables 44 exert lateral forces against the interior of the first tube 12. The natural consumables, being course particulate matter with a certain amount of humidity, may exhibit characteristics of viscosity, friction or stickiness, which when packed under pressure will tend to retain its shape and not fall out of the cavity it is filled in.

Figure 1W:
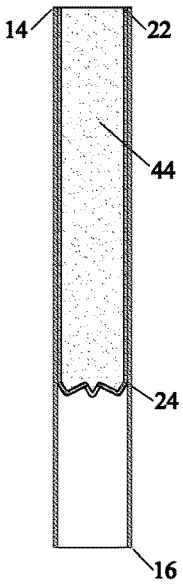
FIG. 1W is a profile view of an embodiment of a cartridge showing the second tube with consumables filled therein.
Figure 1G:
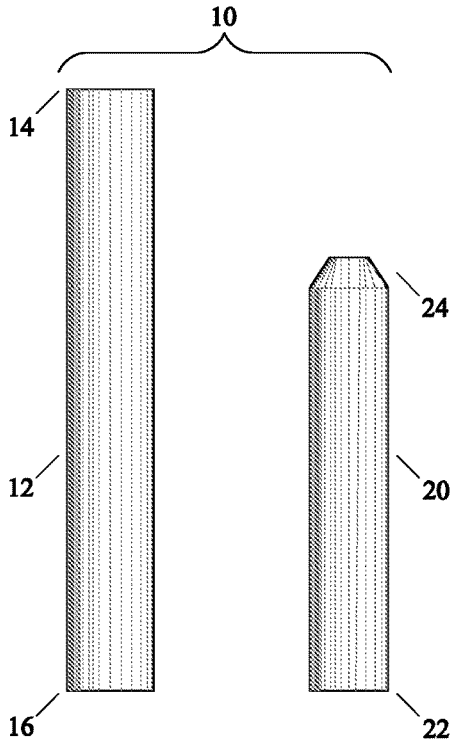
FIG. 1G is a profile view of another embodiment of a cartridge having a first tube and a second tube.
Figure 1H:
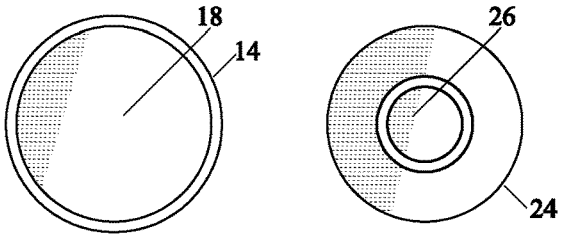
FIG. 1H is a top view of another embodiment of a cartridge showing the first tube and the second tube.
Figure 1J:
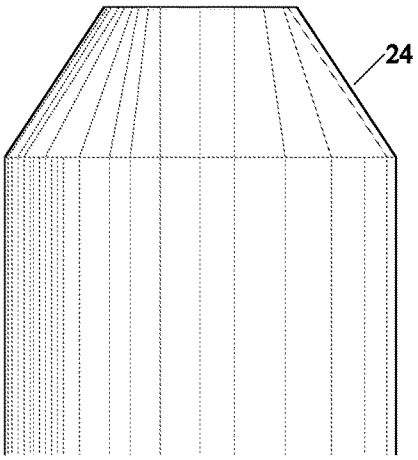
FIG. 1J is an exploded profile view of another embodiment of a cartridge showing the stopper end of a second tube.
Figure 1K:
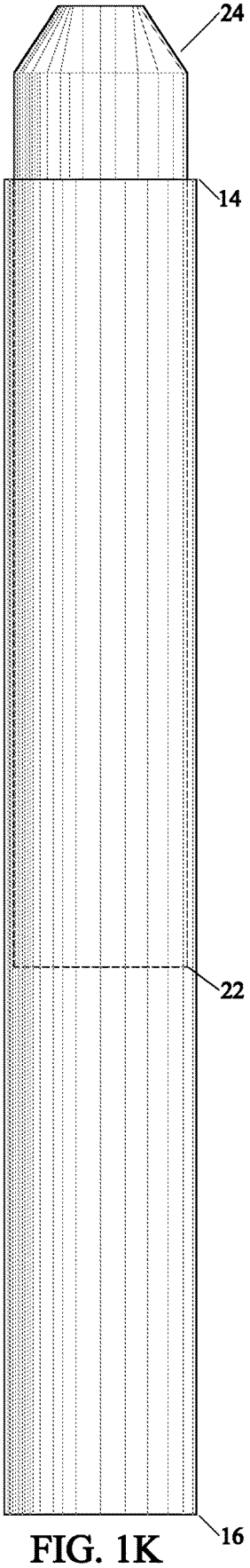
FIG. 1K is a profile view of another embodiment of a cartridge showing a second tube partially inserted into a first tube.
Figure 1L:
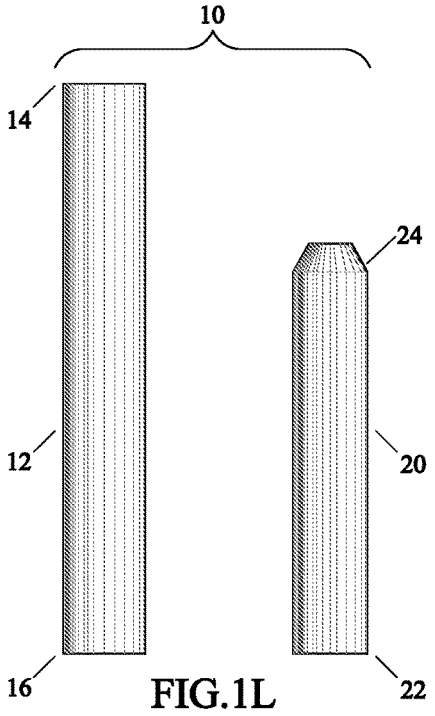
FIG. 1L is a profile view of another embodiment of a cartridge having a first tube and a second tube.
Figure 1N:
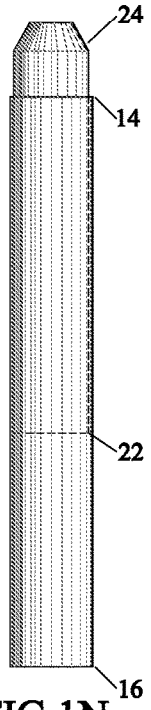
FIG. 1N is an exploded profile view of another embodiment of a cartridge showing a second tube partially inserted into a first tube.

In the embodiment shown in FIG. 1W, once the second tube 20 has been completely inserted into the first tube 12, the junction end 22 of the second tube 20 is proximate the insertion end 14 of the first tube 12. This embodiment is similar to the embodiment of FIG. 1F except the tube is inserted in reverse. In this embodiment, the second cavity 26 of the first tube 12 is filled with natural consumables 44 between the junction end 22 of the second tube 20 and the stopper end 24 of the second tube 20. The second cavity 26 extends towards the insertion end 34 of the first tube 12. FIG. 1W shows how the stopper end 24 is sized and configured to block the natural consumables 44 from falling out of the stopper end 24 and into the first cavity 18. In this embodiment, the natural consumables 44 exert lateral forces against the interior of the second tube 20, while allowing air to pass between the cavities when a user draws on the mouthpiece end.

In a preferred embodiment, the second tube 20 is 36 millimeters in length and the first tube 12 is 50 millimeters in length and 7 millimeters in diameter. The thickness of the paper forming the first tube is contemplated by a person skilled in the art to satisfy requirements in strength, weight, thermal conductivity, etc. The diameter of the second tube 20 must satisfy similar requirements and additionally be adaptable for crimping or ways of forming the shape and strength of the stopper end 24, and also be adapted for an interference fit with the first tube 12. A person skilled in the art will also recognize that variations in inner tube length, the direction to which consumables are packed, the amount of consumables filled, and the location of various obstructions in the form of stoppers and stopper inserts can all be factored into delivering a set dosage to the user.

FIG. 1C shows the interior of the first tube 12 as being the first cavity 18 that is defined by a longitudinal axis and a lateral axis disposed perpendicular to the longitudinal axis. Viewed from the stopper end 24, FIG. 1C also shows the partial interior of the second tube 20 as being a second cavity 26, which like the first cavity 18 is defined by a longitudinal axis and a lateral axis disposed perpendicular to the longitudinal axis.

Figure 7B:
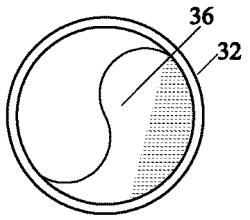
FIG. 7B is a top view of another embodiment of a cartridge showing the interior of the single tube.
Figure 7A:
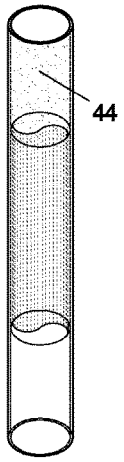
FIG. 7A is a perspective view of another embodiment of a cartridge showing the interior of the single tube with consumables filled therein.

In a preferred embodiment of the cartridge 10 shown in FIG. 1D, the second tube 20 may have a rigid wall construction 28 to maintain its shape when it forms an interference fit with the first tube 12 and the compression, lateral forces described above. In another embodiment, the first tube 12 may likewise have a rigid wall construction. For example, both the first tube 12 and the second tube 20 may be formed from layers of bonded rolled paper treated with an adhesive such as polyvinyl acetate (PVAC). FIGS. 7C-7E depict how paper can be rolled to form a single tube 30. Other methods of tube construction known in the art are also contemplated so as to achieve adequate rigidity in the first tube 12 and the second tube 20. In other embodiments discussed in detail below, the material from which the cartridge 10 is made may be non-combustible at the normal operating temperatures of the heating device.

Dies and presses that are adapted to crimp, squeeze, or insert objects into such tubes are expressly contemplated. The exact shape of the die may vary based on the shape of the crimp or squeeze as known to a person of ordinary skill in the art. FIGS. 8-8F depict the crimping press used with a crimping die and crimping tray to crimp the cartridges 10.

Figure 1M:
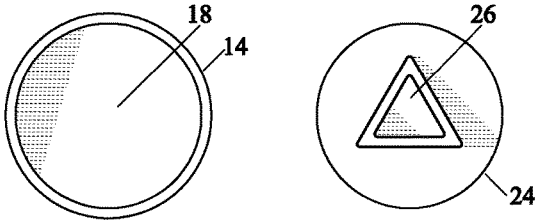
FIG. 1M is a top view of another embodiment of a cartridge showing the first tube and the second tube.
Figure 1P:
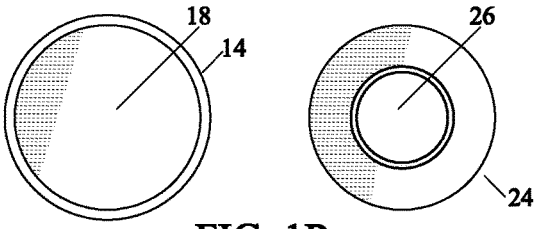
FIG. 1P is a top view of another embodiment of a cartridge showing the first tube and the second tube.
Figure 1Q:
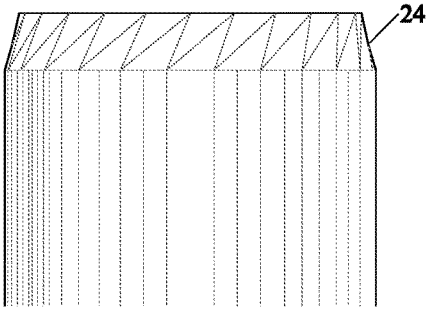
FIG. 1Q is an exploded profile view of another embodiment of a cartridge showing the stopper end of a second tube.
Figure 1R:
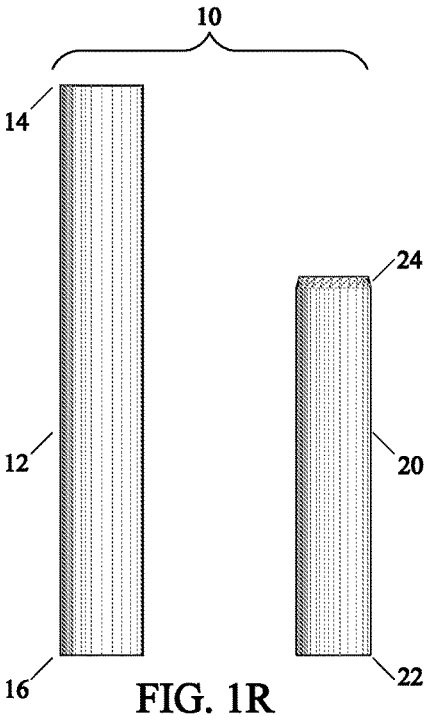
FIG. 1R is a profile view of another embodiment of a cartridge having a first tube and a second tube.
Figure 1S:
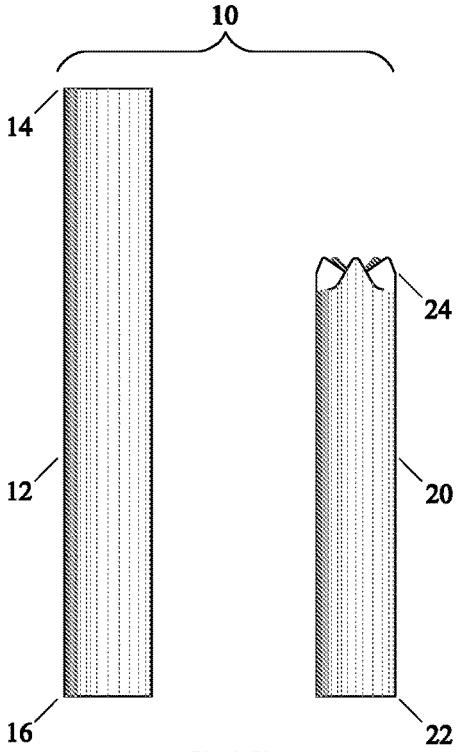
FIG. 1S is a profile view of another embodiment of a cartridge having a first tube and a second tube.
Figure 1T:
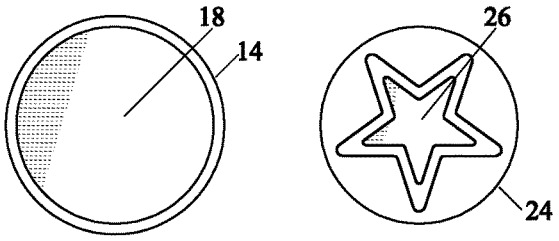
FIG. 1T is a top view of another embodiment of a cartridge showing the first tube and the second tube.
Figure 1U:
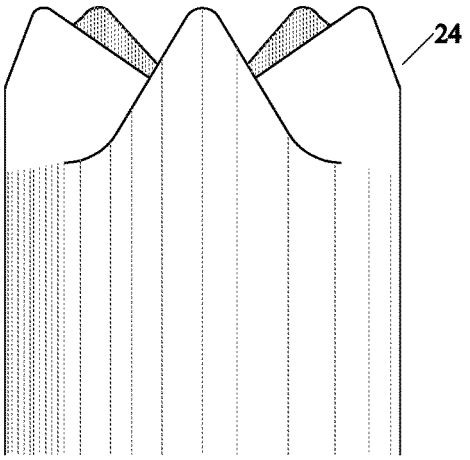
FIG. 1U is an exploded profile view of another embodiment of a cartridge showing the stopper end of a second tube.
Figure 1V:
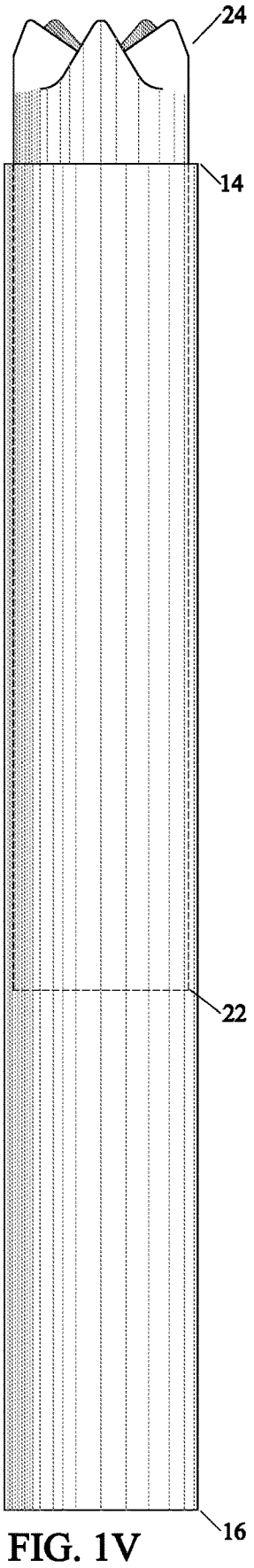
FIG. 1V is a profile view of another embodiment of a cartridge showing a second tube partially inserted into a first tube.
Figure 2A:
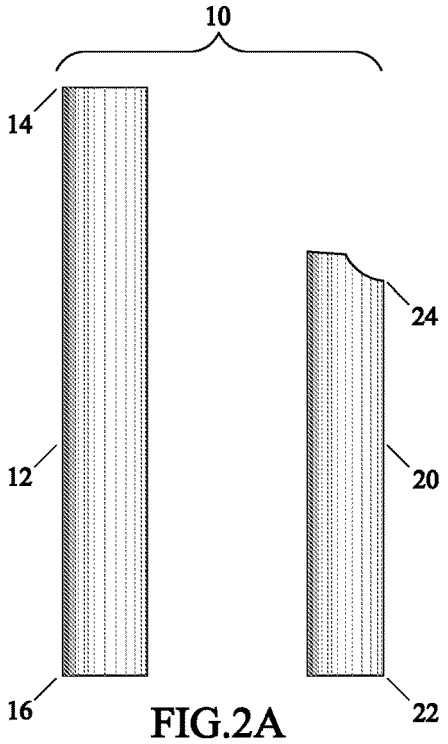
FIG. 2A is a profile view of another embodiment of a cartridge having a first tube and a second tube.
Figure 2B:
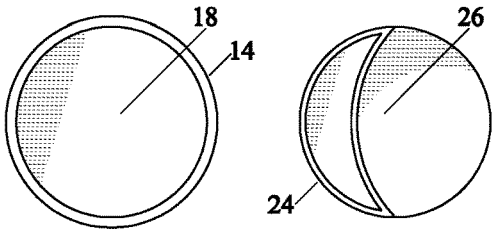
FIG. 2B is a top view of another embodiment of a cartridge showing the first tube and the second tube.
Figure 2D:
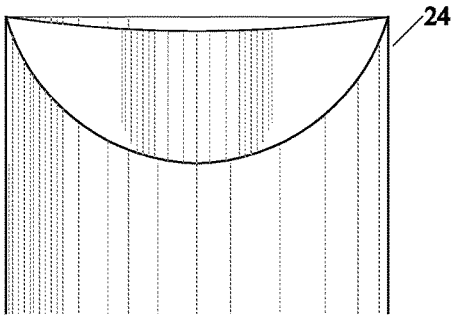
FIG. 2D is an exploded profile view of another embodiment of a cartridge showing the stopper end of a second tube.
Figure 2C:
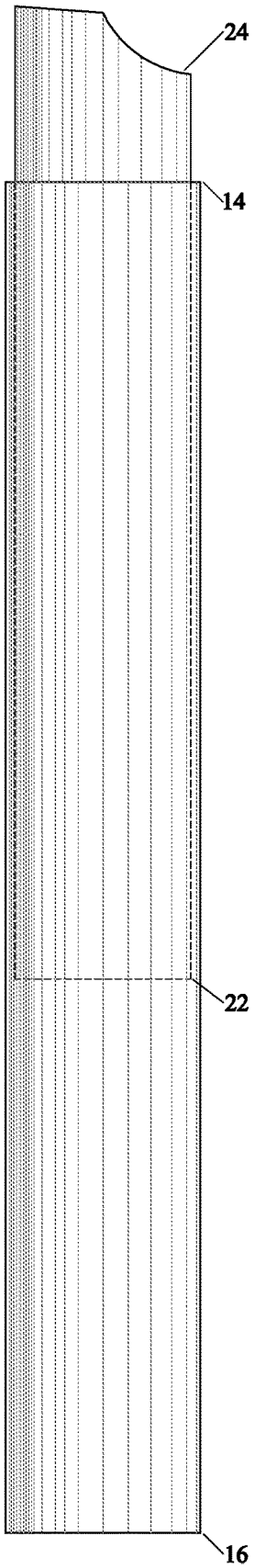
FIG. 2C is a profile view of another embodiment of a cartridge showing a second tube partially inserted into a first tube.
Figure 2E:
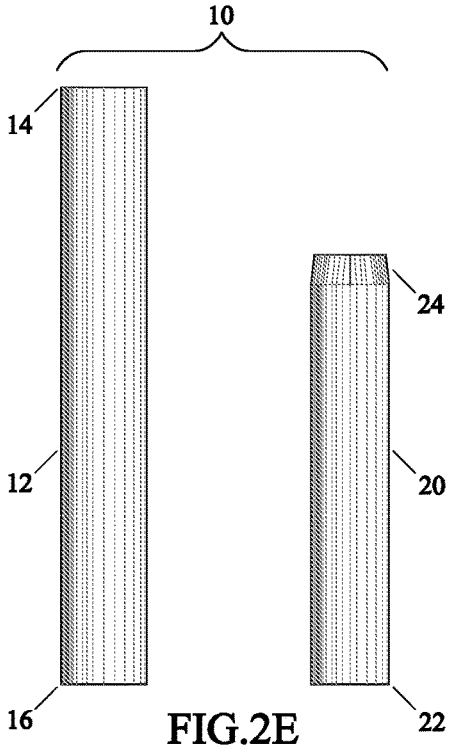
FIG. 2E is a profile view of another embodiment of a cartridge having a first tube and a second tube.
Figure 2F:
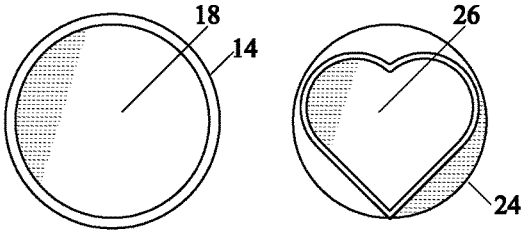
FIG. 2F is a top view of another embodiment of a cartridge showing the first tube and the second tube.
Figure 2H:
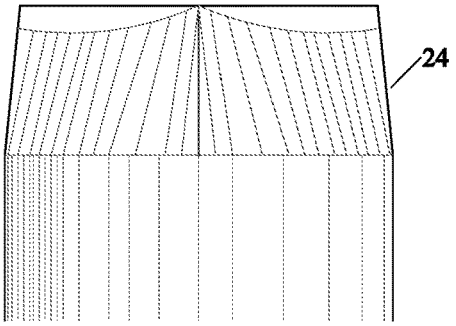
FIG. 2H is an exploded profile view of another embodiment of a cartridge showing the stopper end of a second tube.
Figure 2G:
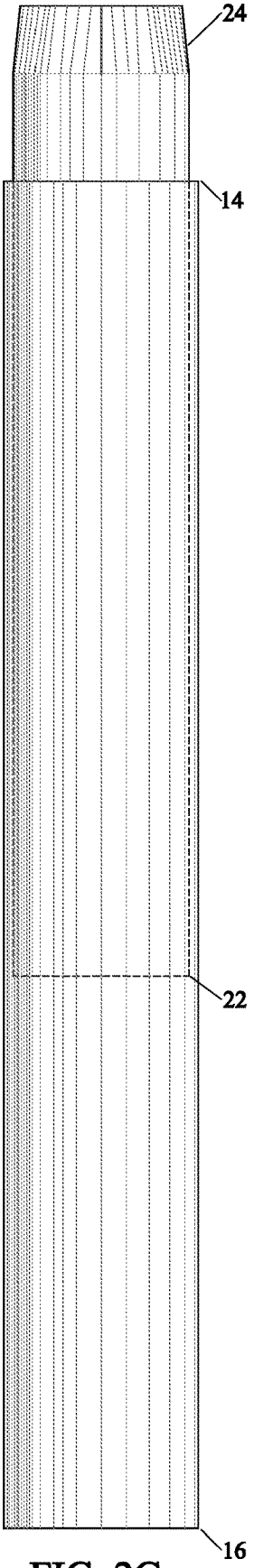
FIG. 2G is a profile view of another embodiment of a cartridge showing a second tube partially inserted into a first tube.
Figure 2J:
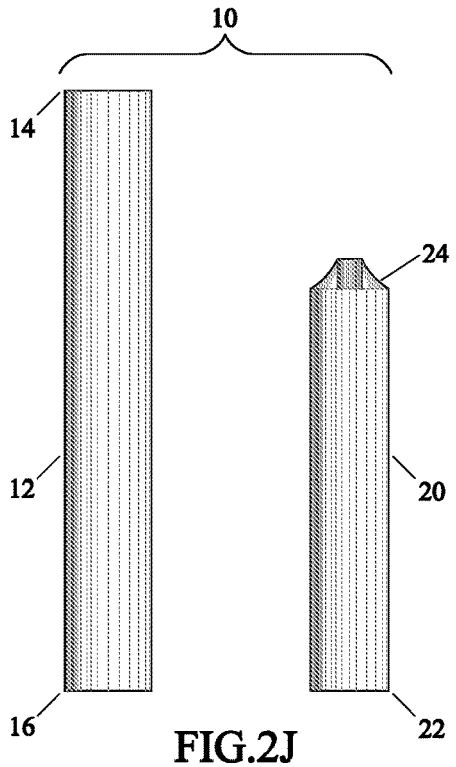
FIG. 2J is a profile view of another embodiment of a cartridge having a first tube and a second tube.
Figure 2K:
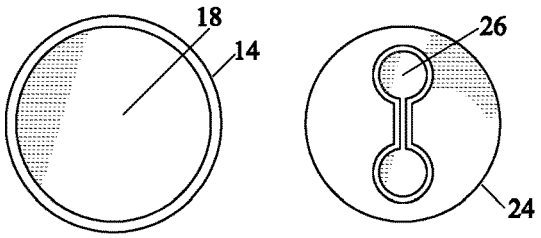
FIG. 2K is a top view of another embodiment of a cartridge showing the first tube and the second tube.
Figure 2M:
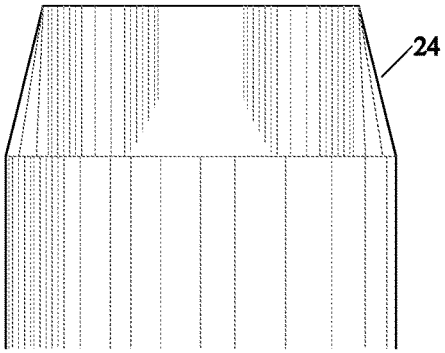
FIG. 2M is an exploded profile view of another embodiment of a cartridge showing the stopper end of a second tube.
Figure 2L:
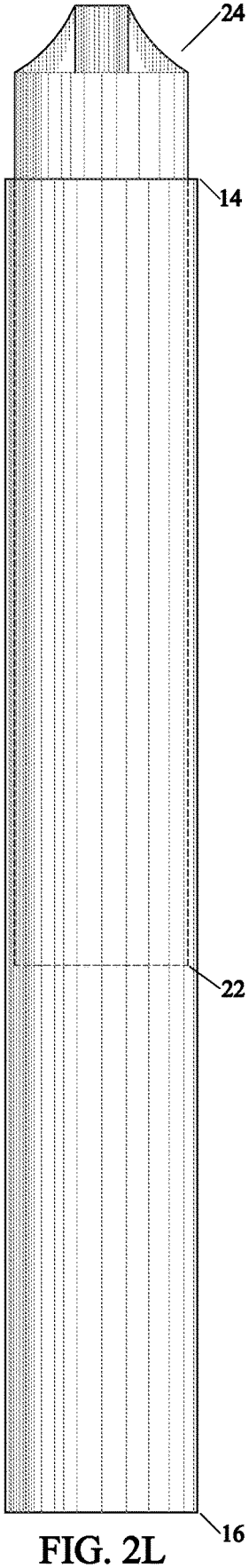
FIG. 2L is a profile view of another embodiment of a cartridge showing a second tube partially inserted into a first tube.
Figure 2N:
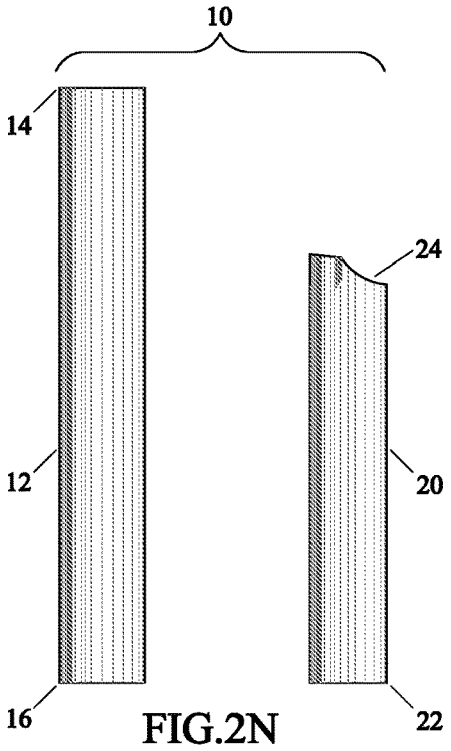
FIG. 2N is a profile view of another embodiment of a cartridge having a first tube and a second tube.
Figure 2P:
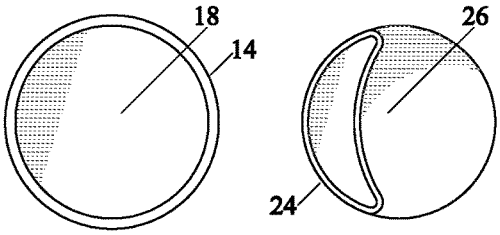
FIG. 2P is a top view of another embodiment of a cartridge showing the first tube and the second tube.
Figure 2R:
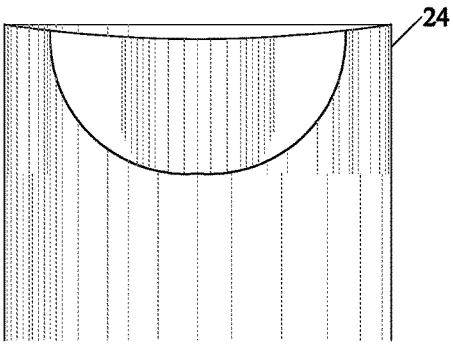
FIG. 2R is an exploded profile view of another embodiment of a cartridge showing the stopper end of a second tube.
Figure 2Q:
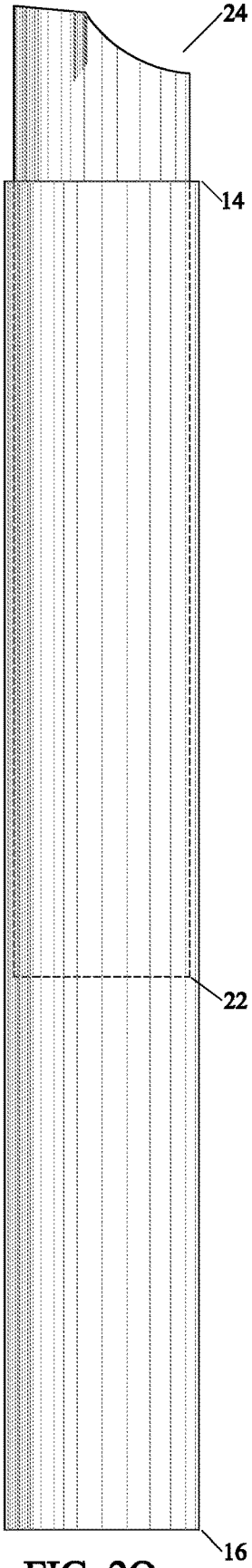
FIG. 2Q is a profile view of another embodiment of a cartridge showing a second tube partially inserted into a first tube.
Figure 2S:
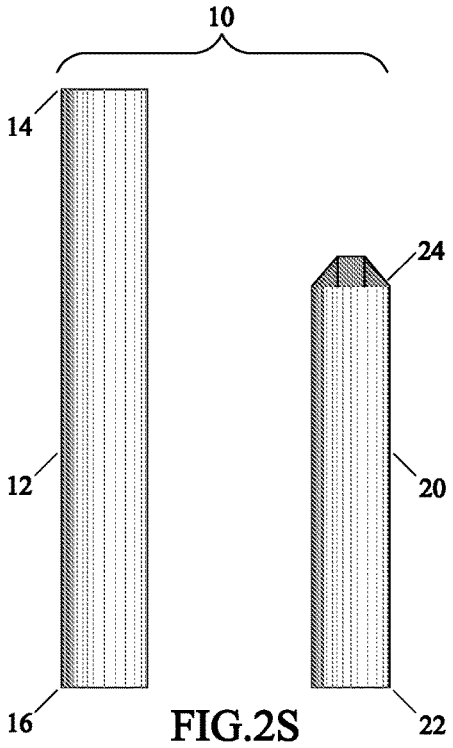
FIG. 2S is a profile view of another embodiment of a cartridge having a first tube and a second tube.
Figure 2T:
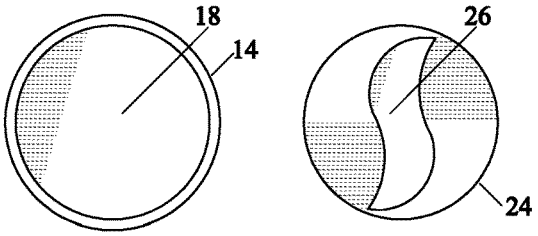
FIG. 2T is a top view of another embodiment of a cartridge showing the first tube and the second tube.
Figure 2V:
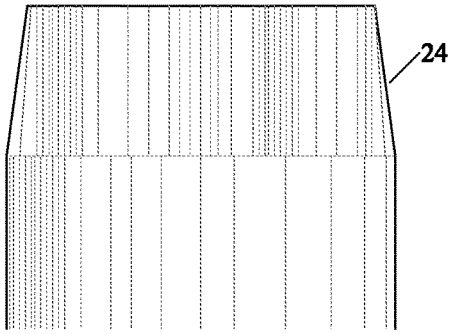
FIG. 2V is an exploded profile view of another embodiment of a cartridge showing the stopper end of a second tube.
Figure 2U:
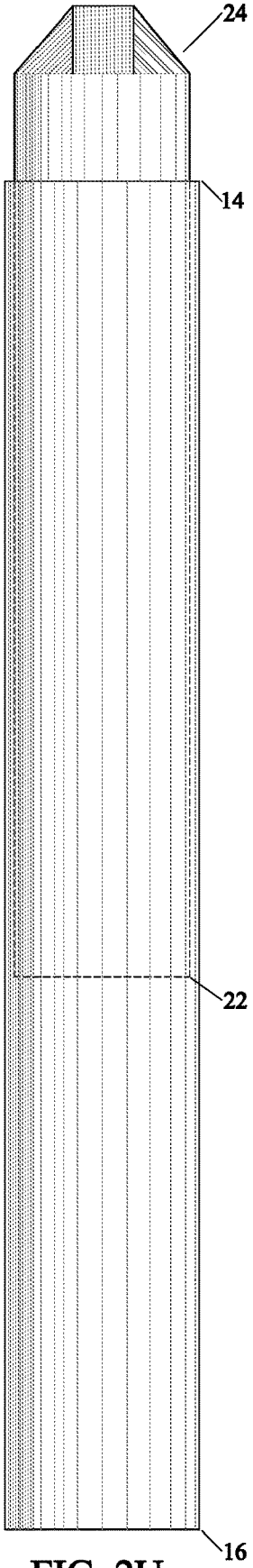
FIG. 2U is a profile view of another embodiment of a cartridge showing a second tube partially inserted into a first tube.
Figure 3A:
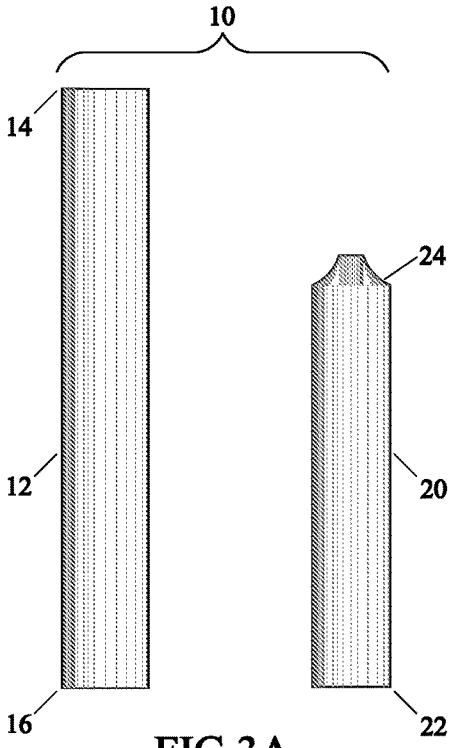
FIG. 3A is a profile view of another embodiment of a cartridge having a first tube and a second tube.
Figure 3C:
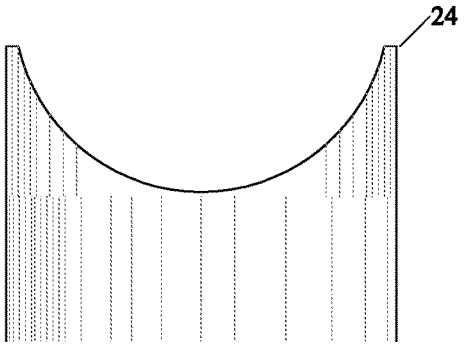
FIG. 3C is an exploded profile view of another embodiment of a cartridge showing the stopper end of a second tube.
Figure 3B:
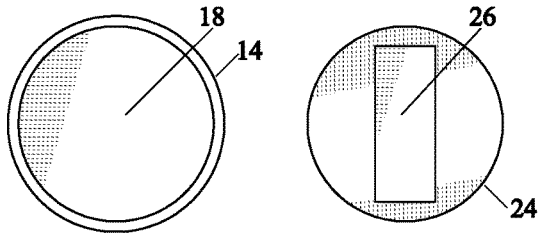
FIG. 3B is a top view of another embodiment of a cartridge showing the first tube and the second tube.
Figure 3D:
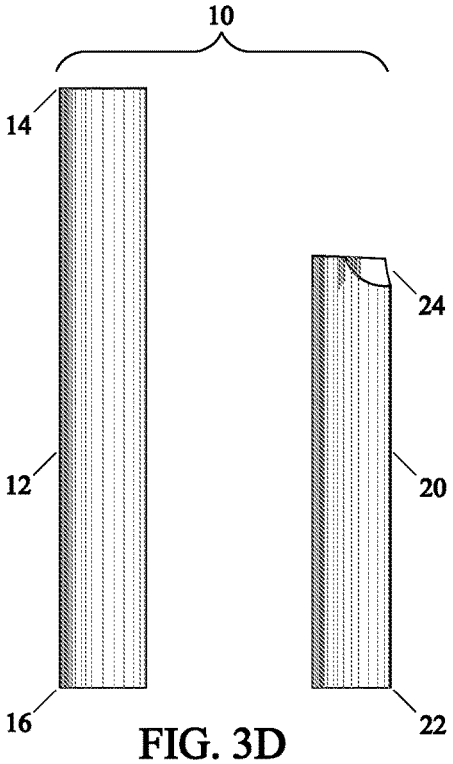
FIG. 3D is a profile view of another embodiment of a cartridge having a first tube and a second tube.
Figure 3E:
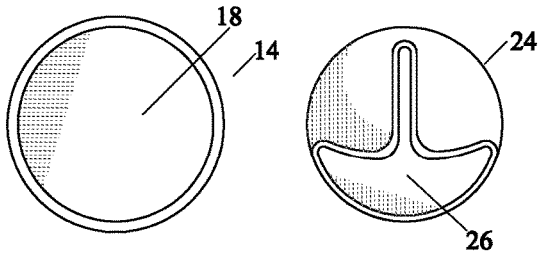
FIG. 3E is a top view of another embodiment of a cartridge showing the first tube and the second tube.
Figure 3F:
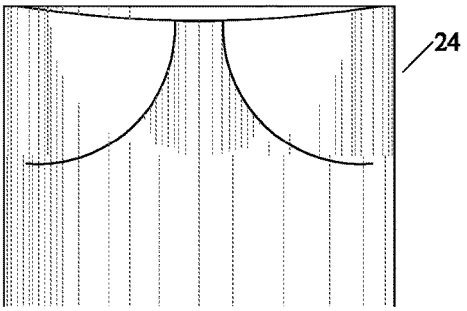
FIG. 3F is an exploded profile view of another embodiment of a cartridge showing the stopper end of a second tube.
Figure 3G:
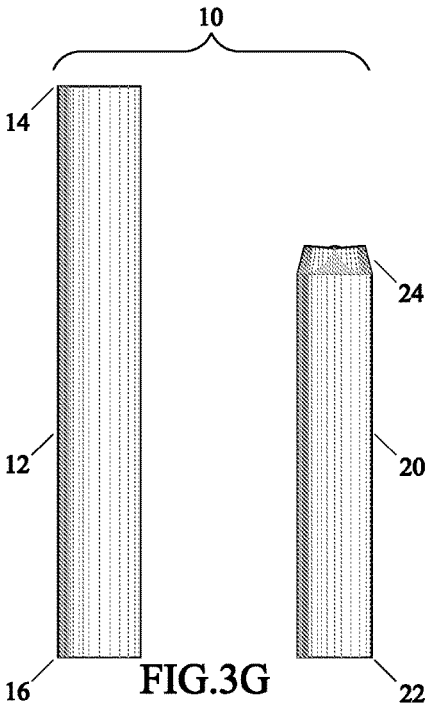
FIG. 3G is a profile view of another embodiment of a cartridge having a first tube and a second tube.
Figure 3H:
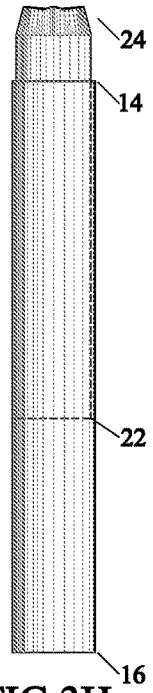
FIG. 3H is a profile view of another embodiment of a cartridge showing the second tube partially inserted into the first tube.
Figure 3J:
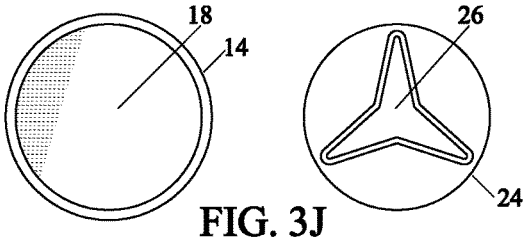
FIG. 3J is a top view of another embodiment of a cartridge showing the first tube and the second tube.
Figure 3K:
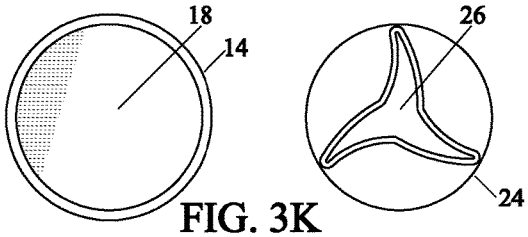
FIG. 3K is a top view of another embodiment of a cartridge showing the first tube and the second tube.
Figure 3L:
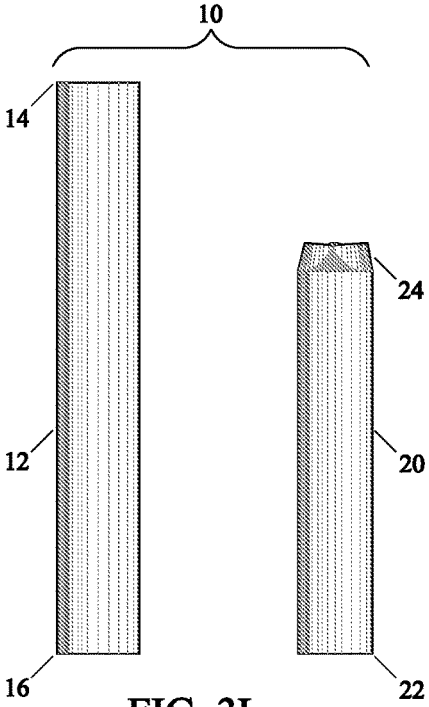
FIG. 3L is a profile view of another embodiment of a cartridge having a first tube and a second tube.
Figure 3M:
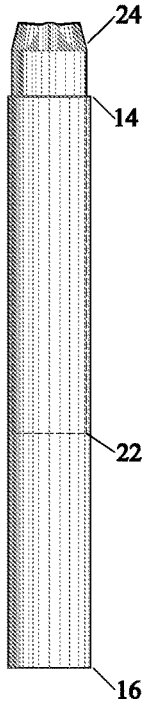
FIG. 3M is a profile view of another embodiment of a cartridge showing the second tube partially inserted into the first tube.
Figure 3N:
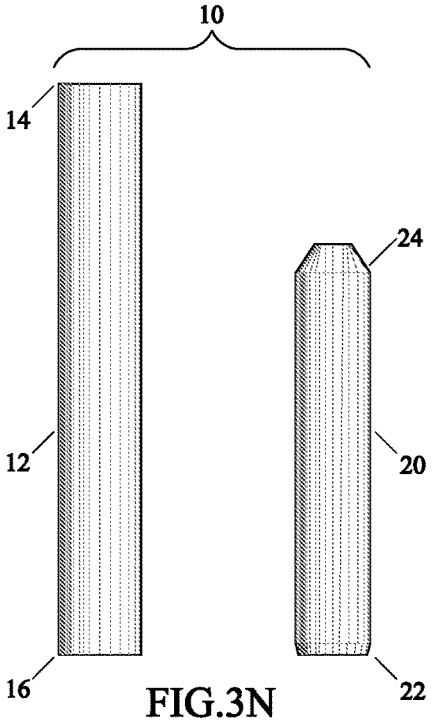
FIG. 3N is a profile view of another embodiment of a cartridge having a first tube and a second tube.
Figure 3P:
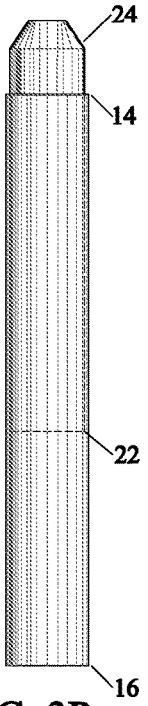
FIG. 3P is a profile view of another embodiment of a cartridge showing a second tube partially inserted into a first tube.
Figure 3Q:
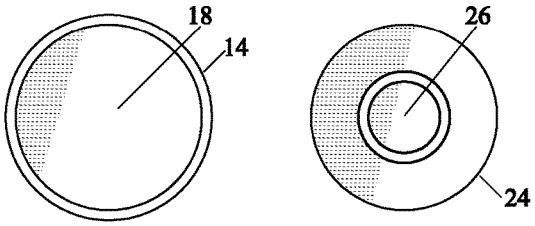
FIG. 3Q is a top view of another embodiment of a cartridge showing a first tube and a second tube.
Figure 3R:
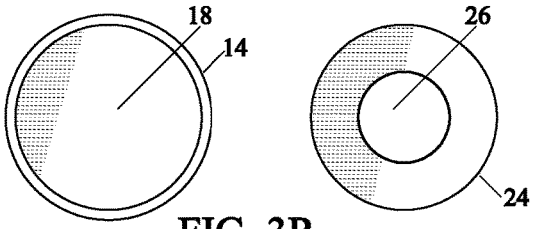
FIG. 3R is a top view of another embodiment of a cartridge showing a first tube and a second tube.
Figure 3S:
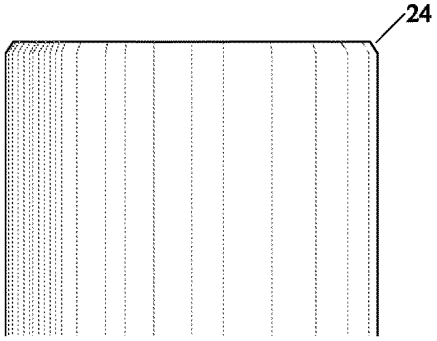
FIG. 3S is an exploded profile view of another embodiment of a cartridge showing the stopper end of a second tube.
Figure 3T:
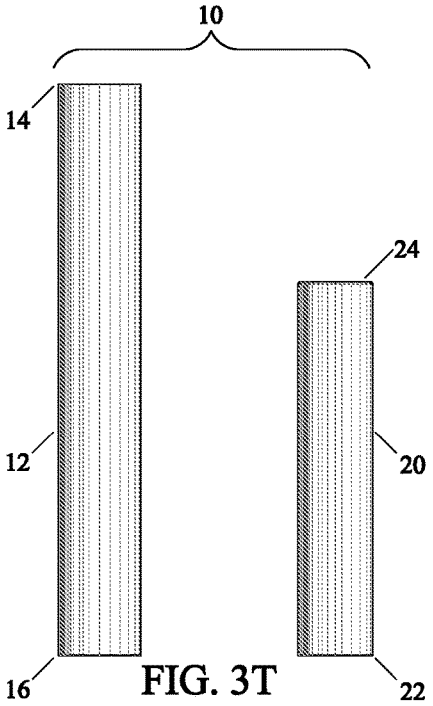
FIG. 3T is a profile view of another embodiment of a cartridge having a first tube and a second tube.
Figure 3U:
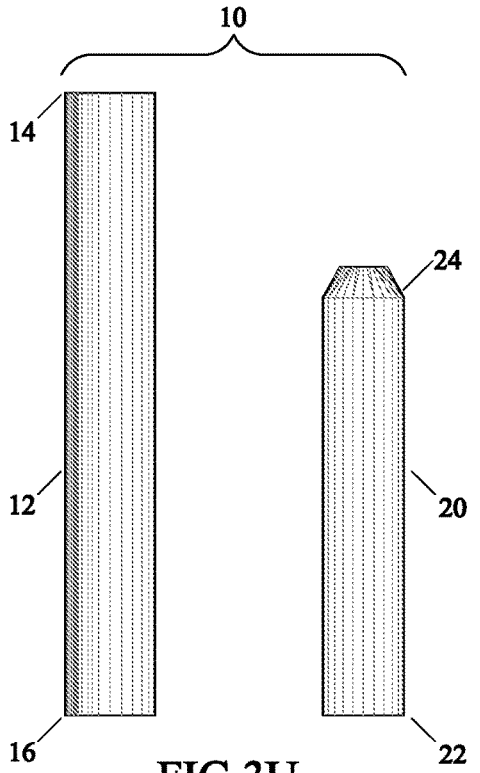
FIG. 3U is a profile view of another embodiment of a cartridge having a first tube and a second tube.
Figure 3W:
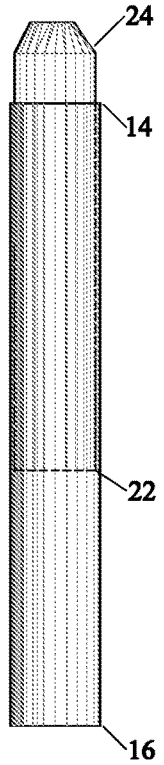
FIG. 3W is a profile view of another embodiment of a cartridge showing a second tube partially inserted into a first tube.
Figure 3V:
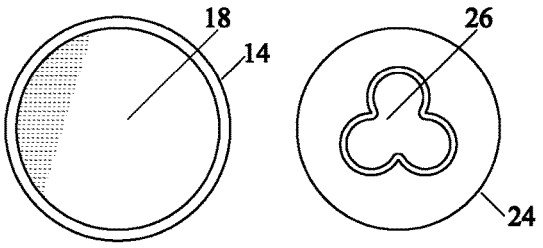
FIG. 3V is a top view of another embodiment of a cartridge showing a first tube and a second tube.
Figure 3X:
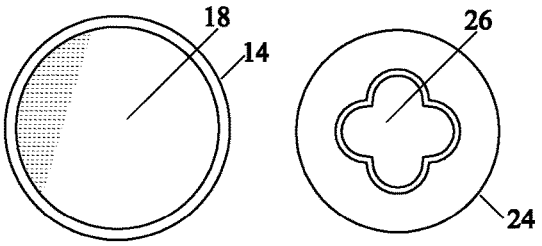
FIG. 3X is a top view of another embodiment of a cartridge showing a first tube and a second tube.
Figure 3Y:
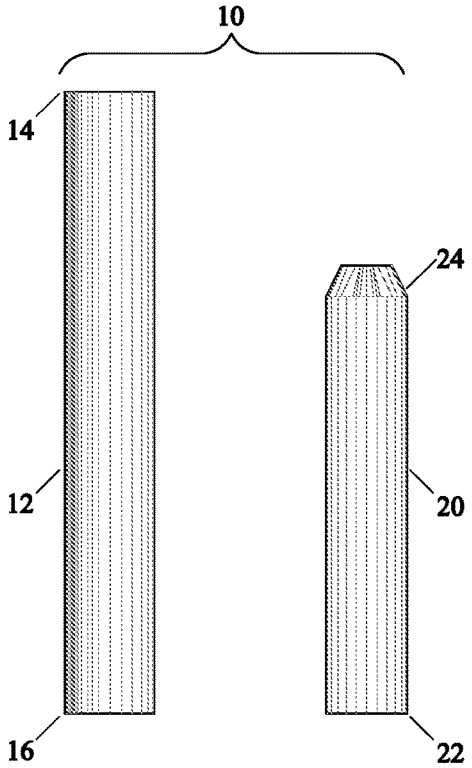
FIG. 3Y is a profile view of another embodiment of a cartridge having a first tube and a second tube.
Figure 4A:
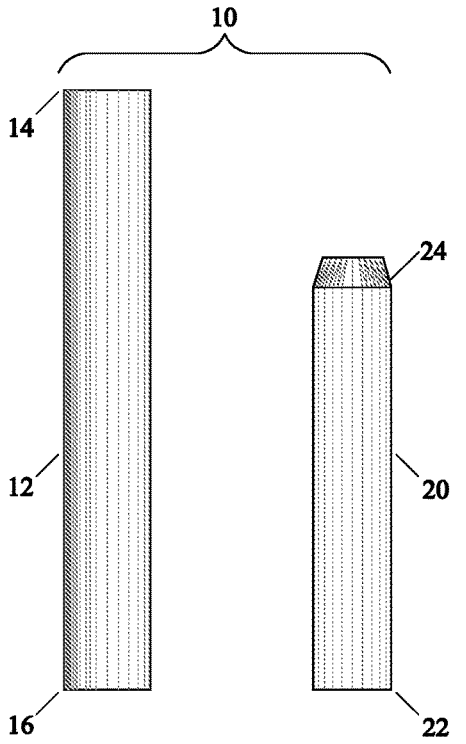
FIG. 4A is a profile view of another embodiment of a cartridge having a first tube and a second tube.
Figure 4C:
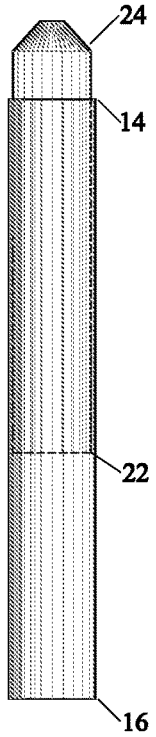
FIG. 4C is a profile view of another embodiment of a cartridge showing a second tube partially inserted into a first tube.
Figure 4B:
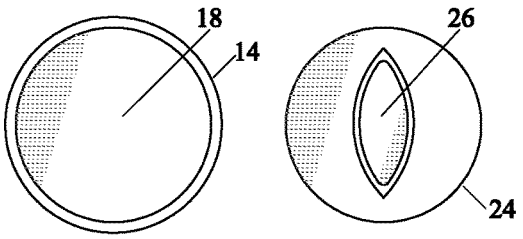
FIG. 4B is a top view of another embodiment of a cartridge showing a first tube and a second tube.
Figure 4D:
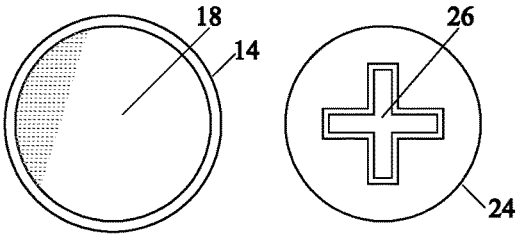
FIG. 4D is a top view of another embodiment of a cartridge showing a first tube and a second tube.
Figure 4E:
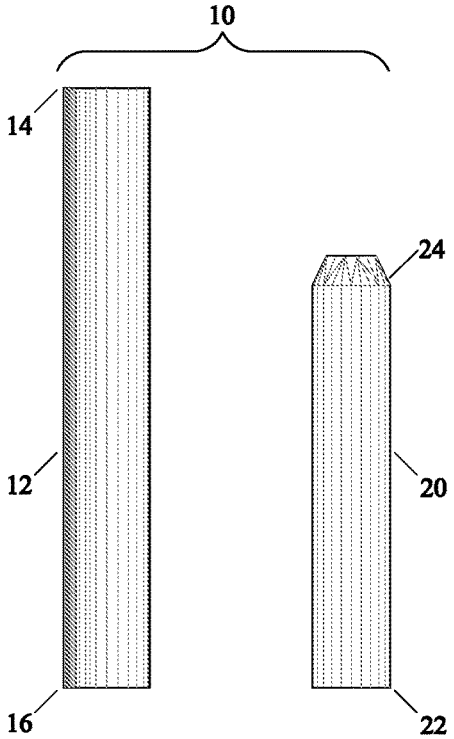
FIG. 4E is a profile view of another embodiment of a cartridge having a first tube and a second tube.
Figure 4F:
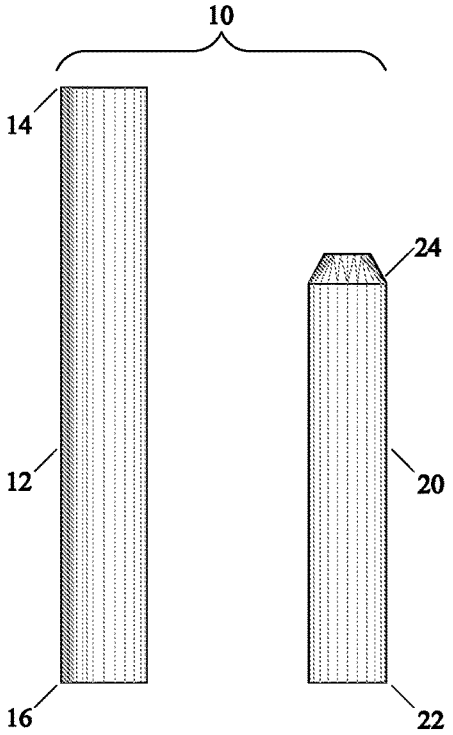
FIG. 4F is a profile view of another embodiment of a cartridge having a first tube and a second tube.
Figure 4H:
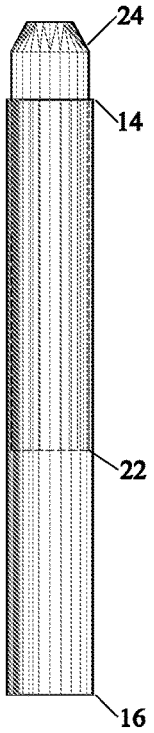
FIG. 4H is a profile view of another embodiment of a cartridge showing a second tube partially inserted into a first tube.
Figure 4G:
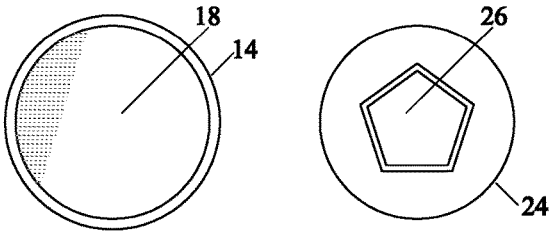
FIG. 4G is a top view of another embodiment of a cartridge showing a first tube and a second tube.
Figure 4J:
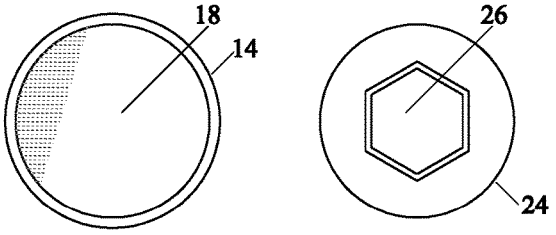
FIG. 4J is a top view of another embodiment of a cartridge showing a first tube and a second tube.
Figure 4K:
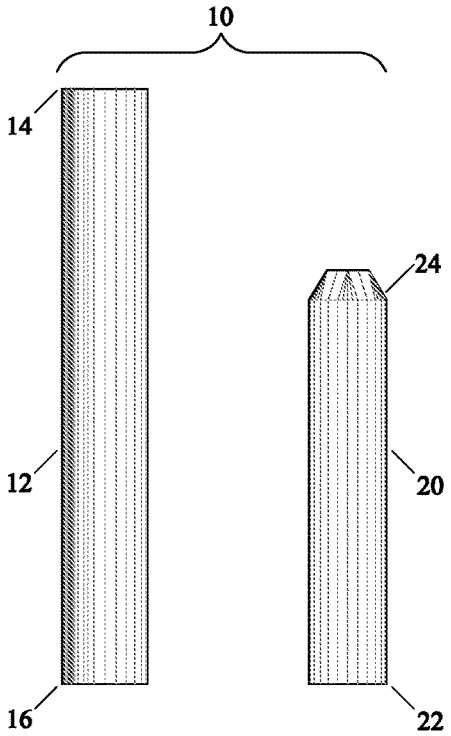
FIG. 4K is a profile view of another embodiment of a cartridge having a first tube and a second tube.
Figure 4L:
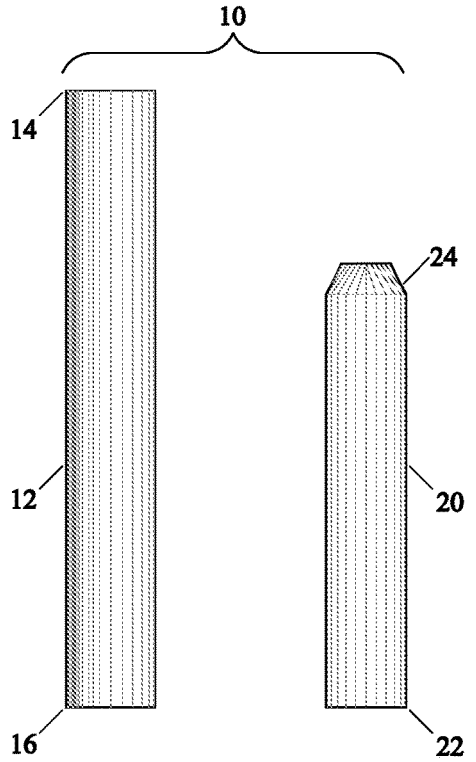
FIG. 4L is a profile view of another embodiment of a cartridge having a first tube and a second tube.
Figure 4N:
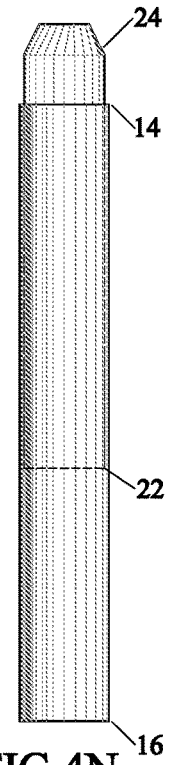
FIG. 4N is a profile view of another embodiment of a cartridge showing a second tube partially inserted into a first tube.
Figure 4M:
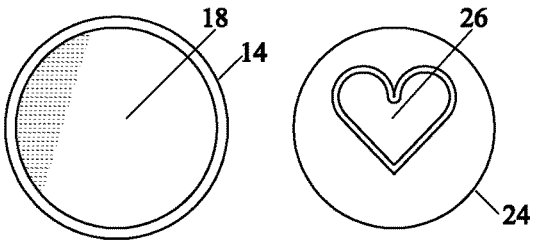
FIG. 4M is a top view of another embodiment of a cartridge showing a first tube and a second tube.
Figure 4P:
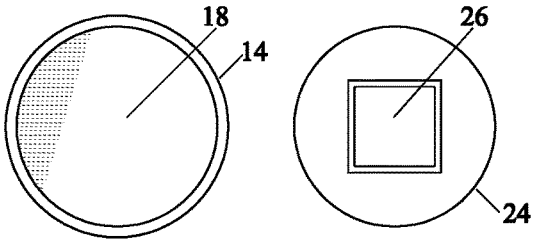
FIG. 4P is a top view of another embodiment of a cartridge showing a first tube and a second tube.
Figure 4Q:
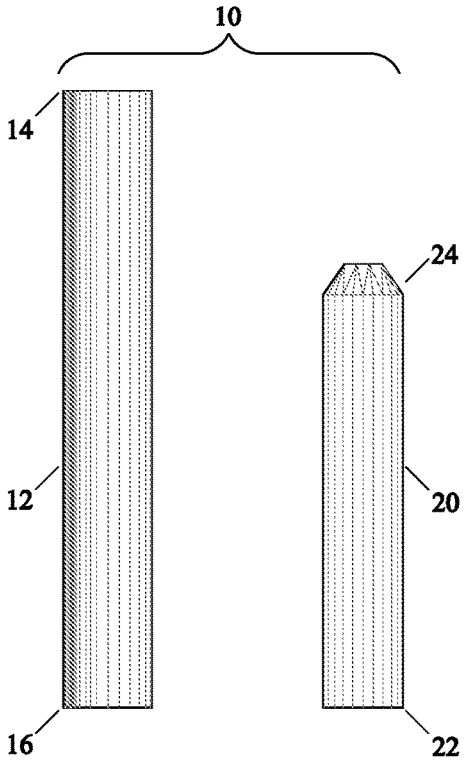
FIG. 4Q is a profile view of another embodiment of a cartridge having a first tube and a second tube.

A second tube 20 and/or a single tube 30 may be formed by crimping the stopper end 22 with dies in the shape of the desired configuration. Expressly contemplated flower cartridge shapes may resemble a tube crimped in 3 places; a tube crimped into a tri-cone shape; a crimped inner tube inserted into an uncrimped outer tube via a tolerance or interference fit; a tube crimped into a heart-shape; a tube crimped into an S-shape; a tube crimped into a Figure-8 shape; a tube crimped into a crescent-shape or smile shape; a tube crimped into a cat's mouth shape; a crimp involving folded sides of the tube, forming the shape of a slot; a crimp involving folded sides, forming the shape of a rough circle; a crimp involving folded sides, forming the shape of a cone; a crimp involving rolled edges of the tubes; a crimp involving a twisted tri-cone. According to one embodiment, the stopper end 22 of the second tube 20 may be crimped to take the shape of a four-pointed star, as shown in FIGS. 1A-1F, 1W. In yet further embodiments, the stopper end 24 of the second tube 20 may take the shape of other configurations, including but not limited to variations of a circle (see FIGS. 1G-1K, 1P-1Q, 3N-3T), a triangle (see FIGS. 1M), a five-pointed star (see FIGS. 1S-1V), a crescent (see FIGS. 2A-2D, 2N-2R), a heart (see FIGS. 2E-2H, 4L-4N), a figure-8 (see FIGS. 2J-2M), an "s"-shape (see FIGS. 2S-2V), a rectangle (see FIGS. 3A-3B), a three-pointed star (see FIGS. 3G-3M), a square (4P-4Q), a three-leafed clover (see FIGS. 3U-3W), a four-leafed clover (see FIGS. 3X-3Y), an oval (see FIGS. 4A-4C), a cross (see FIGS. 4D-4E), a pentagon (see FIGS. 4F-4H), and a hexagon (see FIGS. 4J-4K).

Figure 5A:
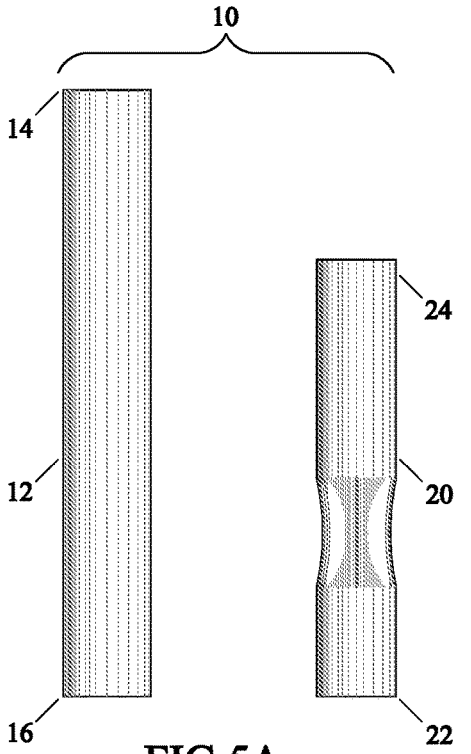
FIG. 5A is a profile view of another embodiment of a cartridge having a first tube and a second tube.
Figure 5B:
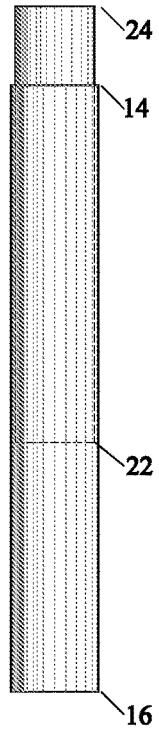
FIG. 5B is a profile view of another embodiment of a cartridge showing a second tube partially inserted into a first tube.
Figure 5C:
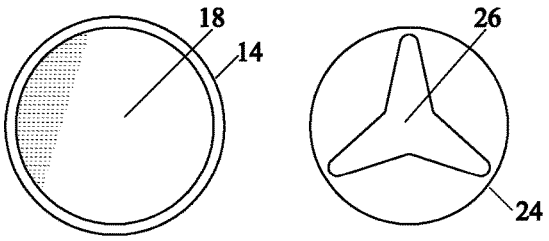
FIG. 5C is a top view of another embodiment of a cartridge showing a first tube and a second tube.
Figure 5D:
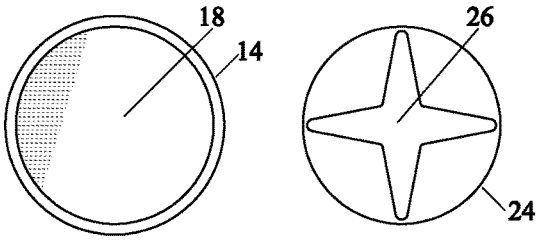
FIG. 5D is a top view of another embodiment of a cartridge showing a first tube and a second tube.
Figure 5E:
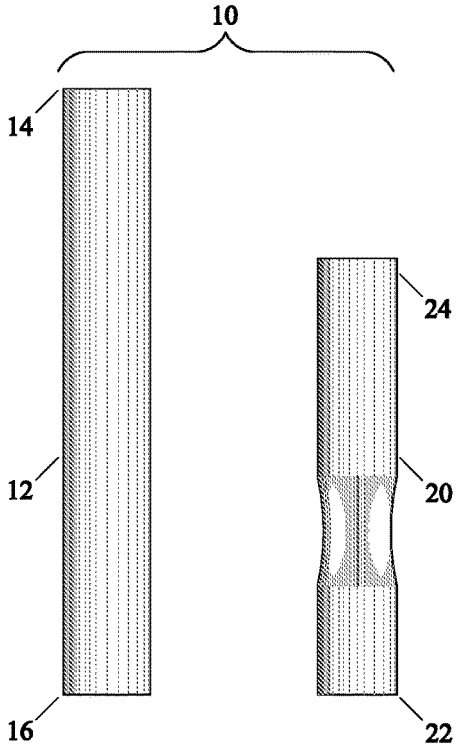
FIG. 5E is a profile view of another embodiment of a cartridge having a first tube and a second tube.

In other embodiments, the second tube 20 may be crimped at some point between the junction end 22 and the stopper end 24 to help prevent the consumables 44 from falling out of the stopper end 24, or to prevent excessive movement of the consumables during the filling process, or subsequent packaging and transport. The second tube 20 may be longitudinally crimped to produce various configurations, including but not limited to a three-pointed star (See FIGS. 5A-5C) via 3-way crimp, a four-pointed star (See FIGS. 5D-5E) via 4-way crimp, a circle (See FIGS. 5F-5H), a spiral circle (See FIGS. 5J-5K) via twisted crimp, or some other shape. It is further contemplated that a single tube 30 that is longitudinally crimped somewhere between the mouthpiece end 32 and the insertion end 34 (See FIGS. 5J-5K) may also serve to prevent consumables 44 from falling out of the mouthpiece end 32, and that this single tube 30 comprises the entirety of flower cartridge 10.

The foregoing shapes formed by crimping of the stopper end and/or other portion of the second tube are given by way of example only and not limitation to only those embodiments specifically disclosed herein. Given the above disclosures, one skilled in the art could devise other variations of a three, four, five or other multi-sided polygon, oval, circle, triangle, or other shape that are within the scope and spirit of the invention disclosed herein.

FIGS. 6A, 6C, 6E, 6G, 6J, and 6K depict various types and shapes for a stopper insert 38 to be inserted into the single tube 30 of a cartridge 10. Cross-sectional views are shown in FIGS. 6B, 6D, 6F, and 6H, of an embodiment of the cartridge 10 wherein a stopper insert 38 of varying shape and size has been inserted into the cavity 36 of a single tube 30. The single tube 30 has openings at a mouthpiece end 32 and an insertion end 34. In FIGS. 6B and 6H, the cavity 36 is shown to be filled with natural consumables 44. The stopper insert 38 may be sized and configured to block the natural consumables 44 from falling out towards the mouthpiece end 32 while still permitting vaporized consumables heated by convection or conduction to flow to the mouthpiece end 32 for inhalation by the user. In one embodiment, the stopper insert 38 may be made of materials that allow it compress upon being placed into the single tube 30, thereby allowing the stopper insert 38 to be of a size and dimension that exceeds the dimensions of the single tube 30 and its cavity 36. When inserted, this creates a tolerance fit between the single tube and the stopper insert and helps retain its position in the tube for later filling of consumables.

Figure 6A:
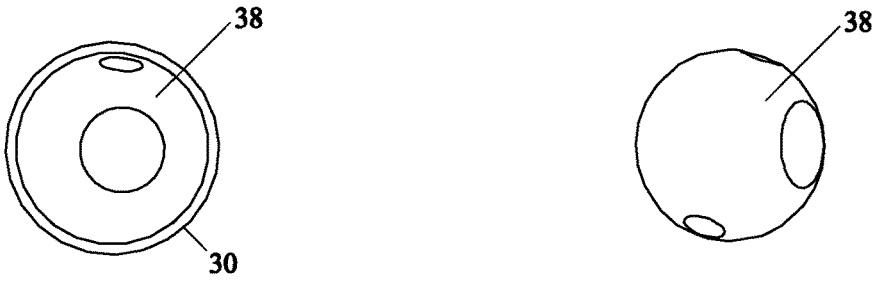
FIG. 6A is a perspective view of a stopper insert for insertion into a single tube and a top view of a stopper insert within a tube.
Figure 6C:
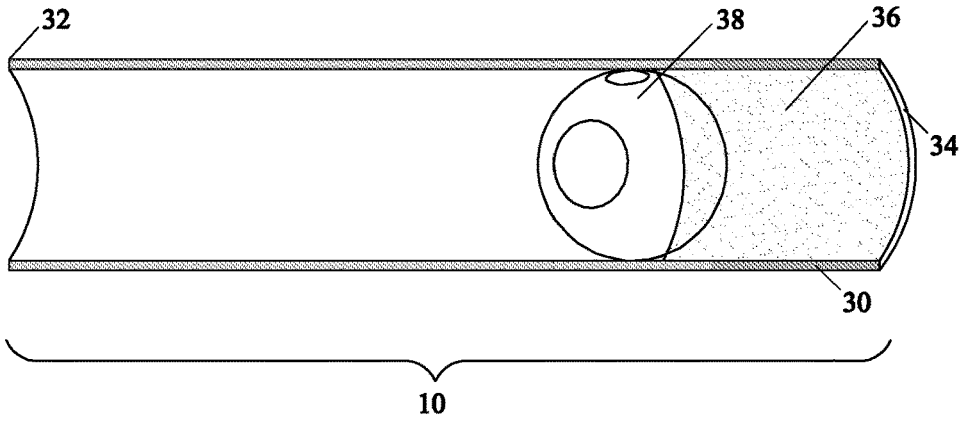
FIG. 6C is a perspective view of a stopper insert for insertion into a single tube and a top view of a stopper insert within a tube.
Figure 6C:
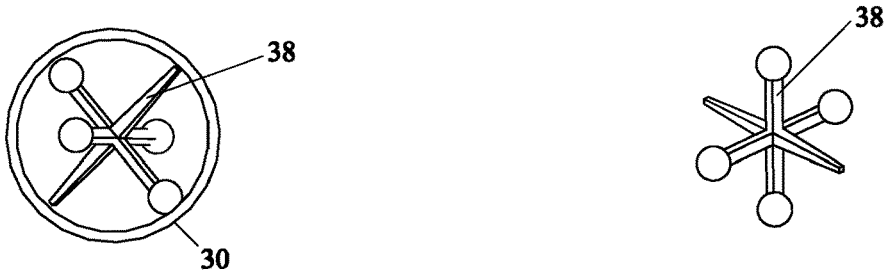
Figure 6D:
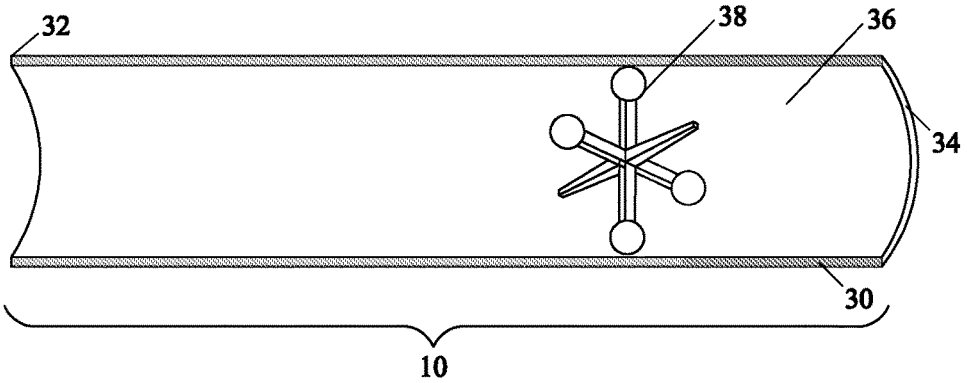
FIG. 6D is a cross-sectional view of a stopper insert inserted into a single tube.
Figure 6E:
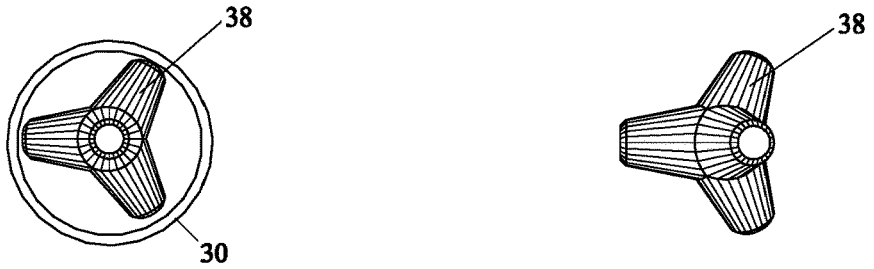
FIG. 6E is a perspective view of a stopper insert for insertion into a single tube and a top view of a stopper insert within a tube.
Figure 6F:
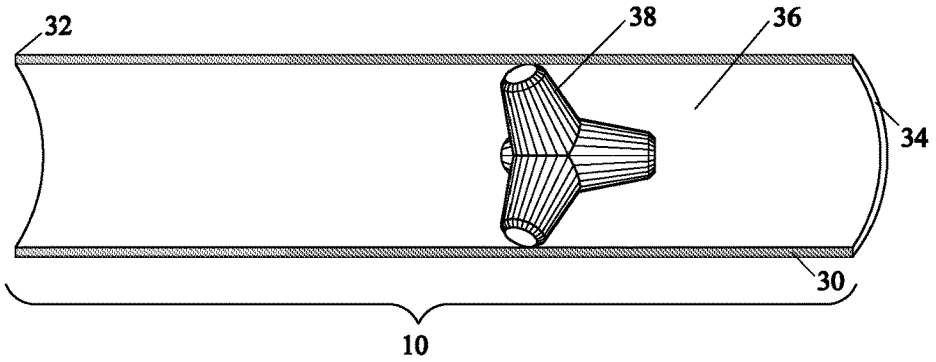
FIG. 6F is a cross-sectional view of a stopper insert inserted into a single tube.
Figure 6G:
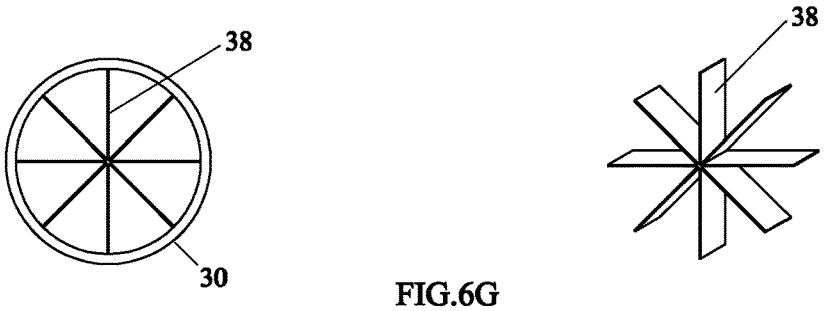
FIG. 6G is a perspective view of a stopper insert for insertion into a single tube and a top view of a stopper insert within a tube.
Figure 6J:
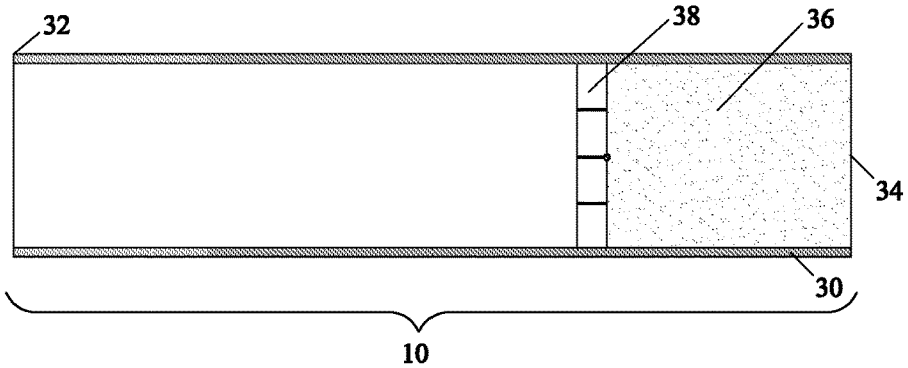
FIG. 6J is a perspective view of a stopper insert for insertion into a single tube.
Figure 6J:
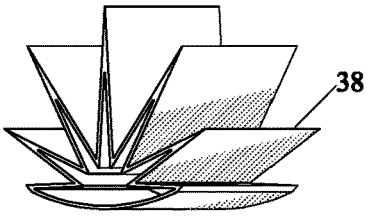
Figure 6K:
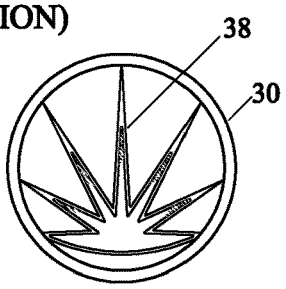
FIG. 6K is a top view of a stopper insert for insertion into a single tube.

FIGS. 6J and 6K depict the stopper insert 38 as being in the shape of the inventor's trademarked logo. According to other embodiments, the stopper 38 alternatively may take a variety of other shapes, including but not limited to a circle, a five-pointed star, a cross, figure-8, "s"-shape, three-sided polygon, four-sided polygon, five-sided polygon, multi-sided polygon, a three-leafed clover, a four-leafed clover, an oval, a circle, etc. Blocking the cavity 36 with a stopper insert 38 having a diameter slightly larger than the single tube 30 for a compression fit is expressly contemplated, so long as adequate convective heating of the natural consumables 44 and inhalation of the active ingredients and desired volatile compounds at various temperature profiles is enabled. Such compounds may comprise cannabinoids, terpenes, nicotine, or other chemicals naturally present in the natural consumables. Such a stopper insert 38 may be made of paper, metal, plastic, ceramic, wood, or textile. In contemplated embodiments, the stopper insert 38 may take the form of a disk, bead, jack, star, ball, or ball, amongst others. The insert functioning as the stopper insert 38 may also be paper folded longitudinally, adapted to have a slightly larger diameter than the single tube 30 when unconstructed, folded into a W, S, N, or other configurations such that the multi-pleated material naturally pushes against the walls of the single tube, forming a compression fit and holding the stopper insert in place.

The foregoing stopper 38 shapes, material, and configurations able to prevent "whole plant" from falling out of the single tube 30 while still permitting vapor to flow to the mouthpiece end 32 are given by way of example only and not limitation to only those embodiments specifically disclosed herein. Given the above disclosures, one skilled in the art could devise other variations of a stopper that are within the scope and spirit of the invention disclosed herein.

Figure 5F:
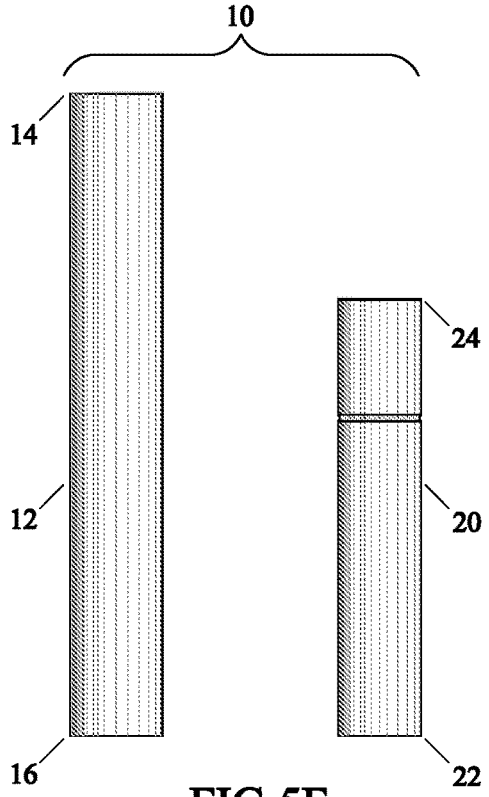
FIG. 5F is a profile view of another embodiment of a cartridge having a first tube and a second tube.
Figure 5H:
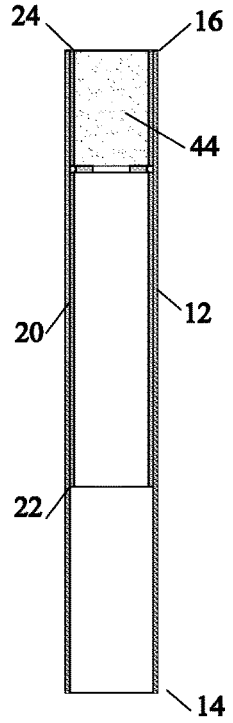
FIG. 5H is a cross sectional view of another embodiment of a cartridge showing a second tube inserted into a first tube with consumables filled therein.
Figure 5G:
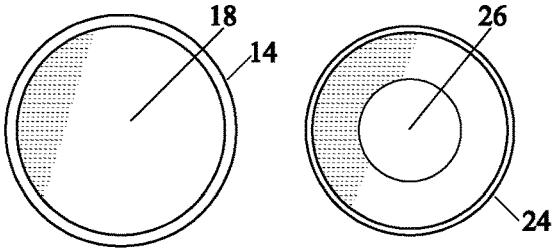
FIG. 5G is a top view of another embodiment of a cartridge showing a first tube and a second tube.
Figure 5J:
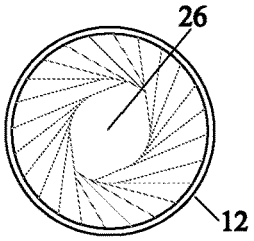
FIG. 5J is a top view of another embodiment of a cartridge having a single tube.
Figure 5K:
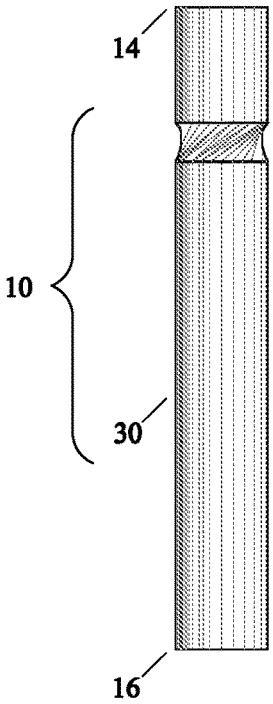
FIG. 5K is a profile view of another embodiment of a cartridge having a single tube.
Figure 7F:
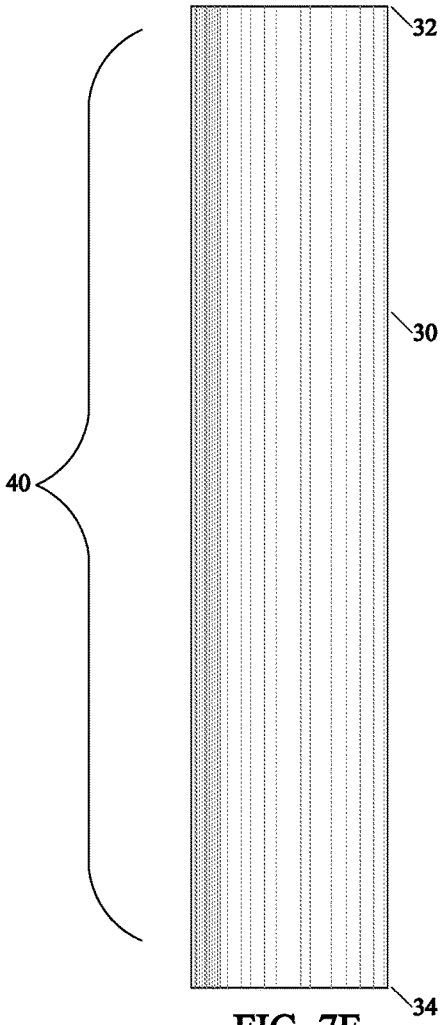
FIG. 7F is a profile view of another embodiment of a cartridge having a single tube.
Figure 7C:
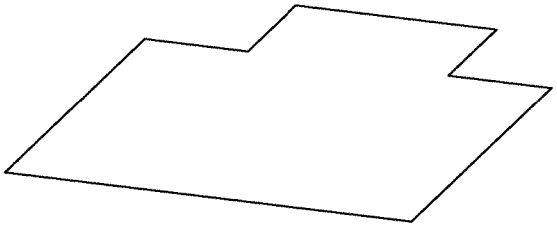
FIG. 7C-7E is a perspective view of paper being folded to form a single tube.
Figure 7D:
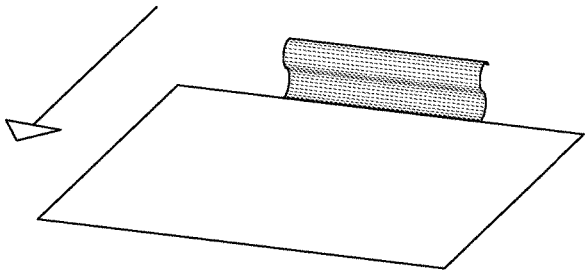
Figure 7E:
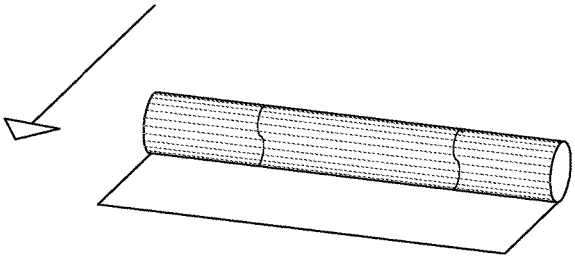

FIG. 7F depicts an embodiment of the cartridge 40 comprised of a single tube 30. The cartridge 40 has a mouthpiece end 32 and an insertion end 34. In lieu of a stopper insert 38, the obstruction used to block consumables from moving past a point in the single tube 30 towards the mouthpiece end 32 may be the formation of a crimp around the circumference of the single tube 30. FIG. 5F depicts how a crimp formed around the circumference of a cartridge 10 having a second tube 20 may appear. In the embodiment shown in FIGS. 7A, 7B, and 7F, the single tube 30 is substantially cylindrical. The insertion end 34 is insertable into the heating device 42 by tolerance fit, as may be shown for example in FIGS. 10C and 10D. The single tube 30 has a cavity 36 defining a longitudinal axis and a lateral axis disposed perpendicular to the longitudinal axis, as shown in FIG. 7B. The cavity 36 may be fillable with natural consumables 44. In this embodiment, the natural consumables 44 exert lateral forces against the interior of the single tube 30. Also, the cartridge 40 may have a stopper 38 sized and configured to be disposable into the cavity 36 proximate the mouthpiece end 32, as shown in FIG. 10. The stopper 38 may be sized and configured to block the natural consumables 44 from falling out of the mouthpiece end 32 while still permitting the vaporized active ingredients that have been heated by convection to flow to the mouthpiece end 32 and be inhaled by the user.

Viewed from the mouthpiece end, FIG. 7B shows the interior of the single tube 30 as being a cavity 36 that is defined by a longitudinal axis and a lateral axis disposed perpendicular to the longitudinal axis.

In another embodiment of the cartridge 40 shown in FIG. 7A-7E, the single tube 30 may be formed by rolling paper including folded or twisted elements structurally positioned in the single tube 30 between the mouthpiece end 32 and the insertion end 34. The area between the mouthpiece end 32 and the obstruction may form a first cavity, while the area between the insertion end 34 and the obstruction may form a second cavity, as shown in FIG. 7A. One of either the first cavity or the second cavity may be filled with natural consumables.

All embodiments of this invention contain a functional constriction in the form of a crimp, a stopper object, or some other obstruction as previously disclosed, such that when natural consumables are filled, the constriction prevents the movement of natural consumables outside of the cavity it is intended for, even when subject to the heavy vibrations during filling and pressure during tamping, as discussed in detail later. However, no cavity is sealed and all manners of constrictions are intended for air to flow relatively freely.

Figure 8A:
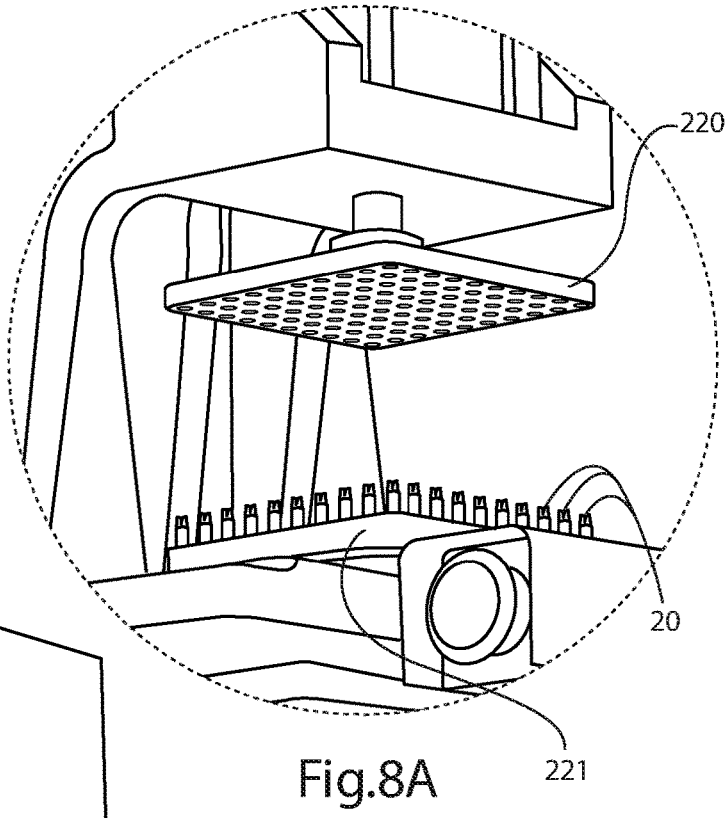
FIG. 8 is a perspective view of a plurality of second tubes undergoing crimping via a pressing process and FIG. 8A is an expanded view of the same.
Figure 8:
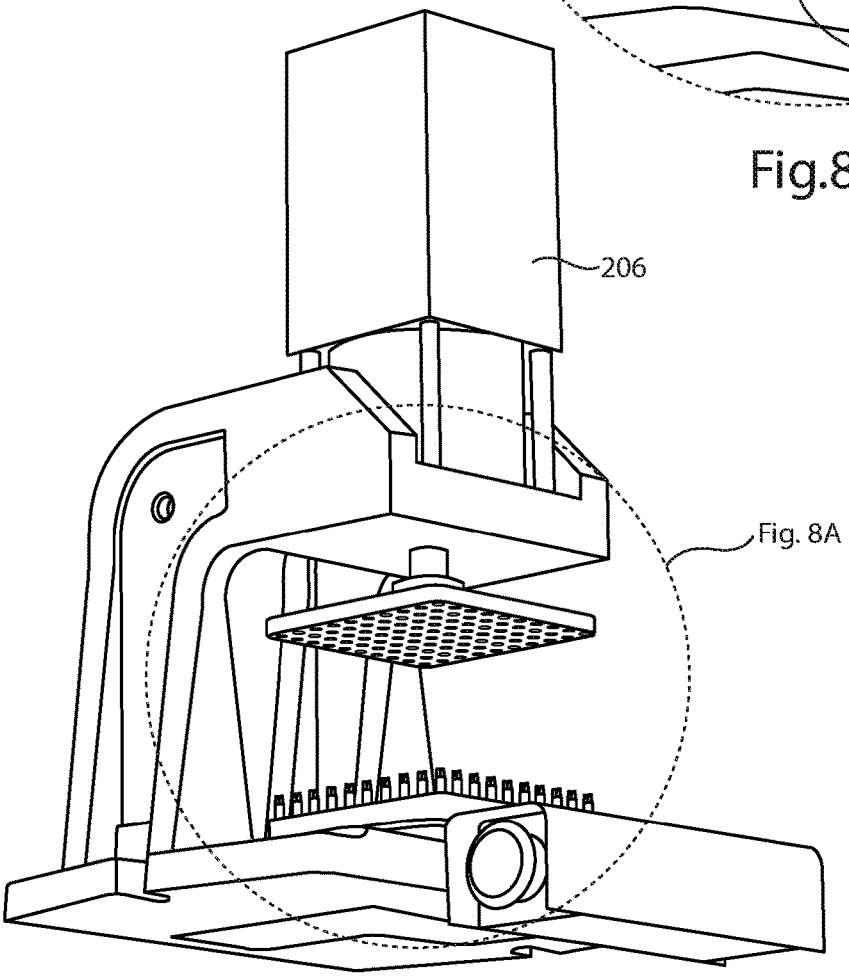

FIG. 8 shows an assembly of second tubes 20 being crimped via a press process of which FIG. 8A shows an expanded view. A number of second tubes 20 are placed upon a base plate 221 with a crimping die plate attached to the top of a press 206. In an exemplary embodiment, the press may be pneumatically powered.

Figure 8B:
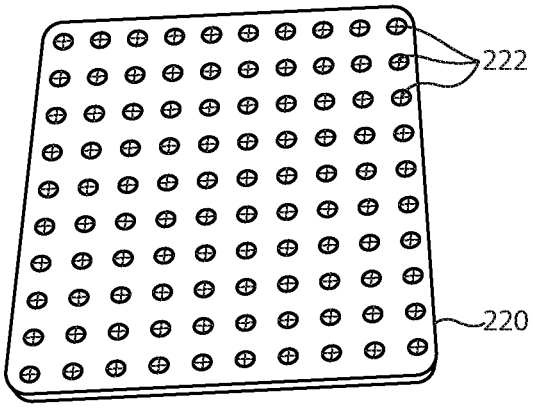
FIG. 8B is an illustration of a crimping die plate with die holes facing up.

FIG. 8B illustrates crimping die plate 220. The die plate has a smooth surface with number of die holes 222 corresponding in location to the base plate. Each hole is a recess shaped like a die, and are adapted, when pressed against the second tube, to form the desired crimped shape of the stopper end.

Figure 8C:
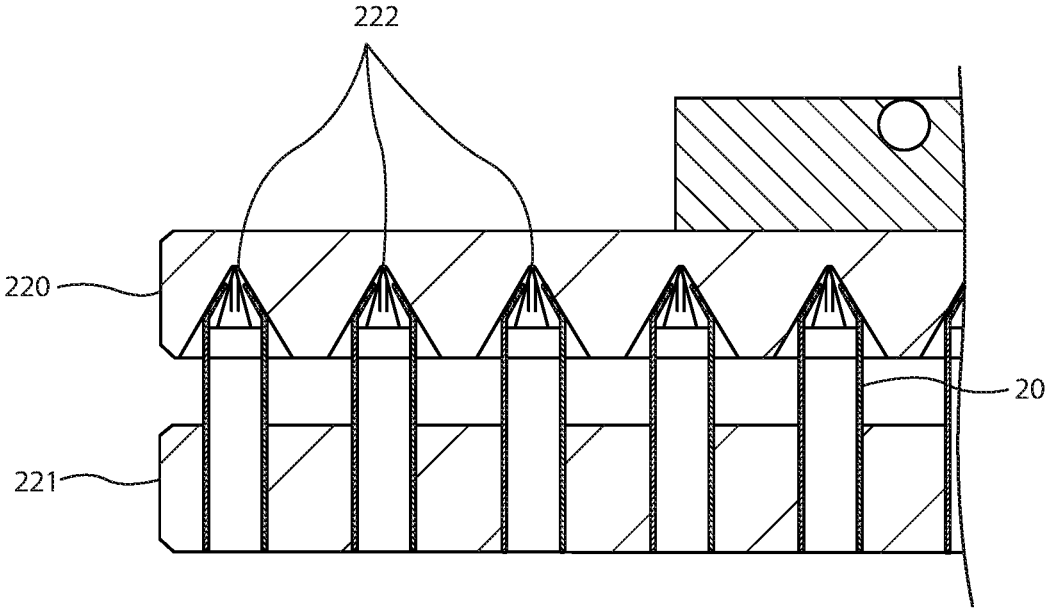
FIG. 8C is a cross-sectional view of second tubes being crimped between a crimping die and a base plate.

FIG. 8C shows a cross section of the base plate 221 and crimping die plate 220 at the moment second tubes 20 are crimped. The second tubes are disposed vertically within holes of the base plate and the crimping die plate is pressed against the arrangement of second tubes 20. When sufficient pressure is applied, the stopper end of the second tubes 20 crumple to form a desired shape. The die holes 222 may form approximate cone shapes to facilitate the positioning of the second tube against the die plate.

Figure 8D:
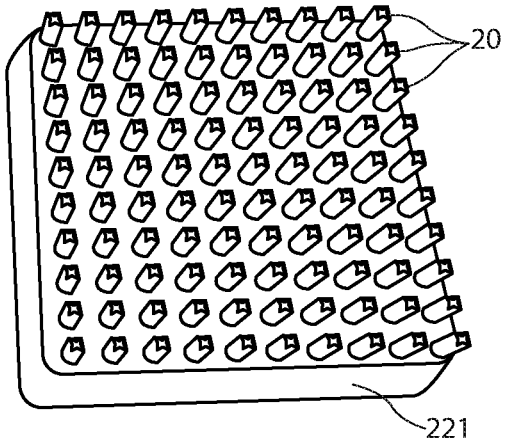
FIG. 8D is an illustration of second tubes placed in the base plate.

FIG. 8D is a perspective view of the base plate with crimped second tubes 20 already inserted. An arbitrary number of tubes are vertically disposed within the base plate. Once the second tubes 20 are fully formed, they are ready to be inserted into corresponding first tubes. It is noted that insertion of second tubes by tolerance fit into first tubes is greatly facilitated by crimping stopper end of the second tube.

Figure 8E:
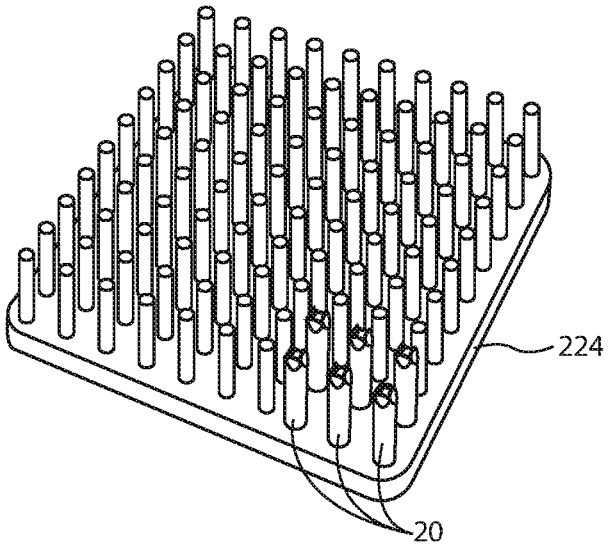
FIG. 8E is a perspective view of a mandrel plate, fitted with a plurality of second tubes.
Figure 8F:
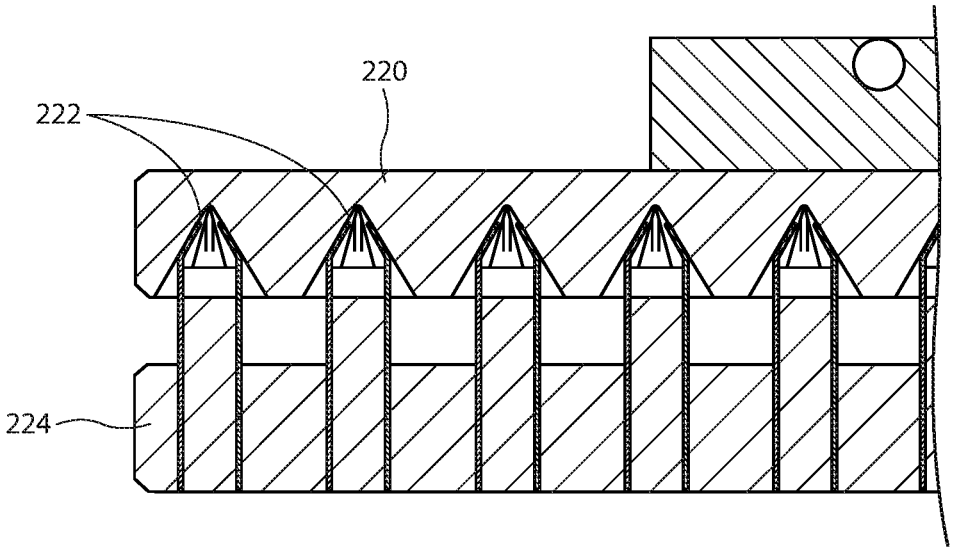
FIG. 8F is a cross-sectional view of second tubes being crimped between a crimping die and a mandrel plate.

FIG. 8E shows another embodiment where instead of a base plate 221, a mandrel plate 224 is used to secure a plurality of second tubes 20 by threading the tubes through the protrusions on the mandrel plate 224. Such protrusions are formed at a height slightly shorter than the length of the second tubes 20. When die plate 220 is pressed against mandrel plate 224, as shown in FIG. 8F, a corresponding crimp is formed on the second tubes. This embodiment, by properly aligning the second tubes 20 and reducing the margin of error, may reduce the risk of improper crimping or damaged second tubes.

FIGS. 9A-D illustrate the filling process. In an exemplary embodiment, the filling process involves filling the natural consumables 44 into empty flower cartridges while vibrating the filling assembly 230 via a vibrating table 210 and tamping by applying a tamping plate against the filled cartridges. The filling process is intended to create a porous plug that retains its shape and remains in place under anticipated usage conditions.

Figure 9A:
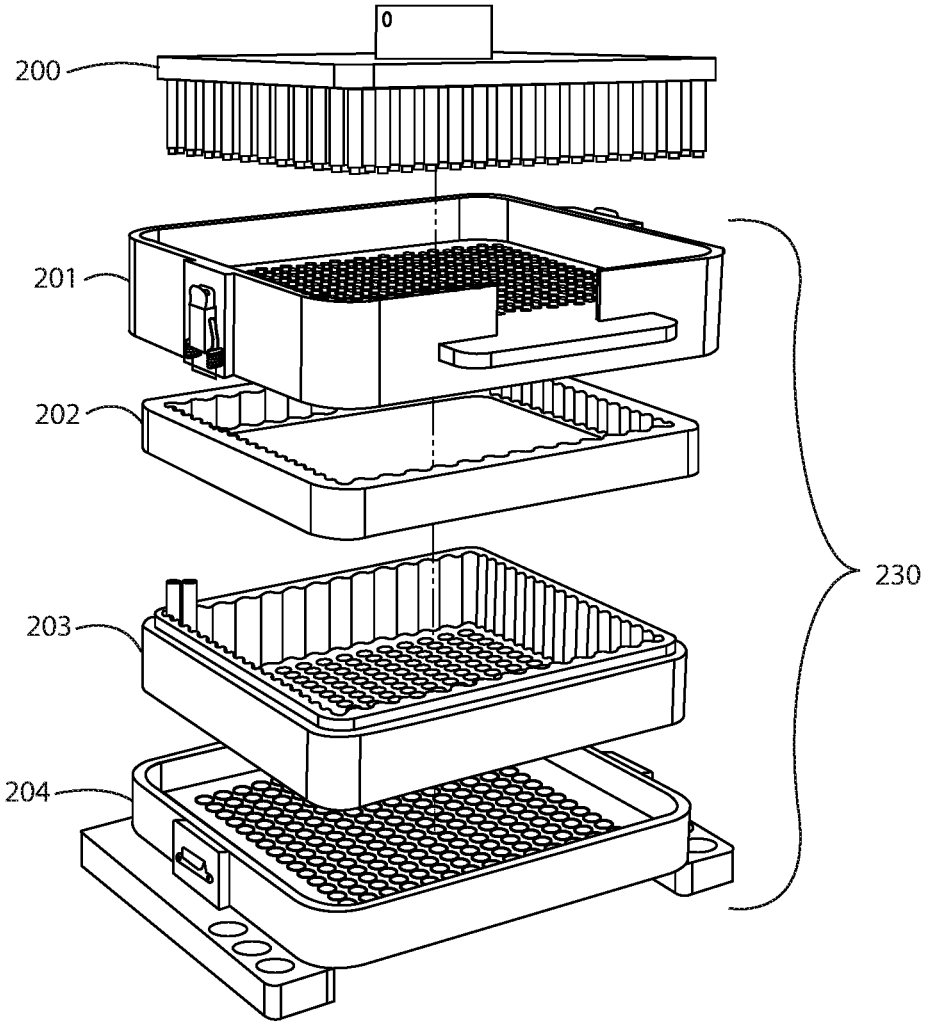
FIG. 9A is an exploded view of the tamping assembly.

FIG. 9A shows an exploded view of the tamping assembly, with a tamping plate 200, a filling tray 201, upper cartridge tray 202, lower cartridge tray 203, and base plate 204. The tamping assembly applies pressure to the natural consumables already loaded into the flower cartridges to immobilize the consumables via friction within the cartridge.

Figure 9B:
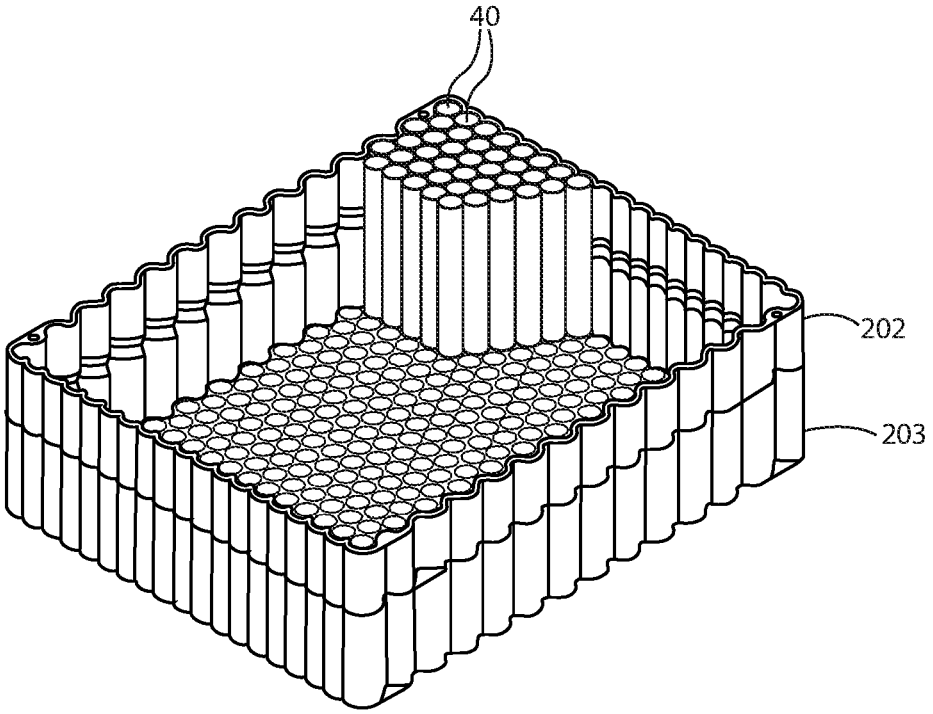
FIG. 9B is an illustration of the upper and lower cartridge trays partially filled with flower cartridges.

FIG. 9B shows the upper and lower cartridge trays assembled together into a cartridge tray assembly. The empty flower cartridges are vertically disposed within the tray assembly, which in an exemplary embodiment may contain 500 cartridges. The cartridge tray assembly is adapted to be easily separable to aid in loading or unloading the flower cartridges. In an exemplary embodiment, the cartridge trays may be made of plastic, and cartridge trays may have removable and/or hinged side panels to aid in loading or unloading flower cartridges.

Figure 9C:
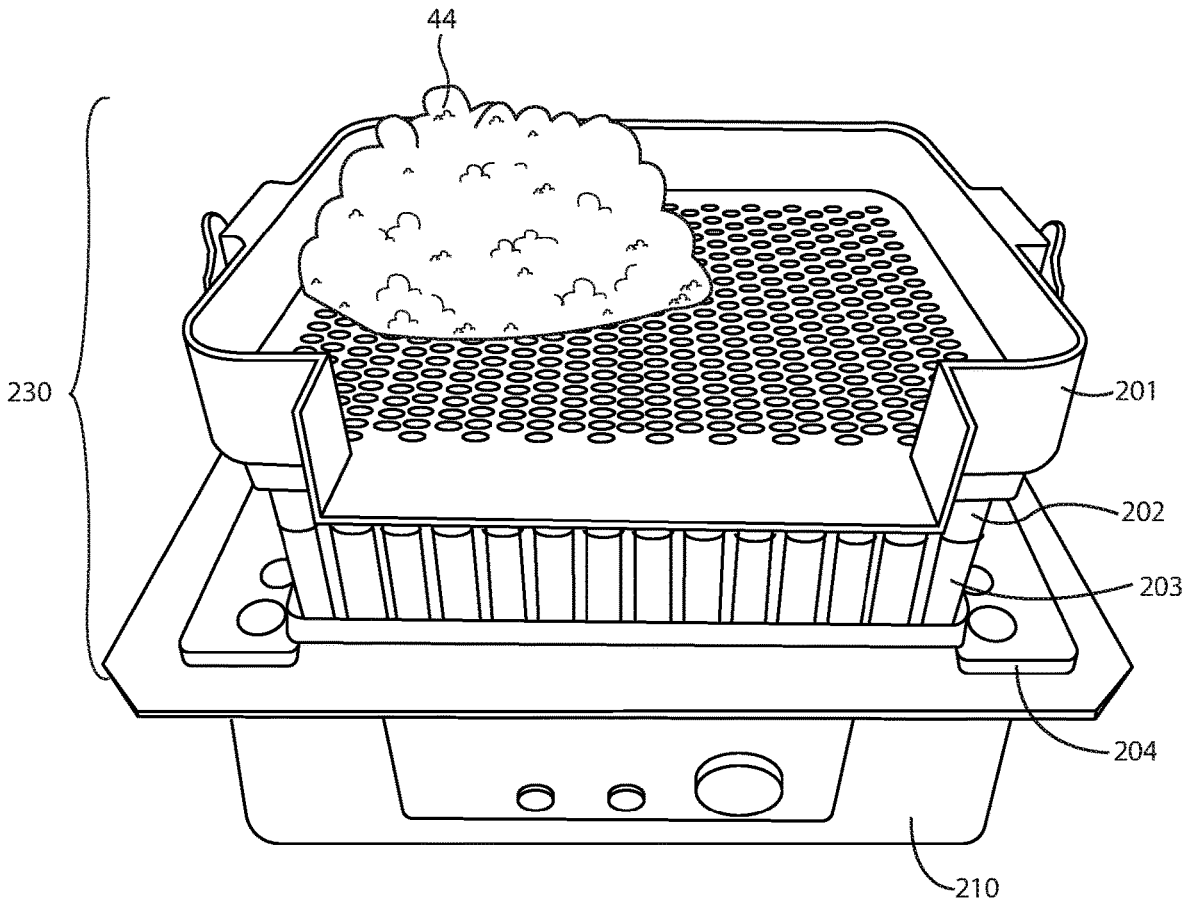
FIG. 9C is an illustration of the filling assembly magnetically coupled to a vibrating table with natural consumables positioned in the filling tray.

FIG. 9C illustrates the filling assembly 230. The upper and lower cartridge trays 202 and 203 are aligned to the filling tray 201 above and to the base plate 204 below. The base plate is magnetically coupled or clamped to the vibrating table 210 surface. Filling tray 201 may be of various depth to accommodate for the different physical properties of the natural consumables, such as moisture content and granularity. Such variations could cause different types of consumables having the same mass to occupy different volumes, necessitating different depths of trays to accommodate different initial densities of the ground flower or plant matter. By using trays of different depths, uniformity in allowing the same mass of ground flower to be compressed into each stick may be achieved, regardless of the original density of the uncompressed ground flower. In an exemplary embodiment, the filling tray may be 8 millimeters to 18 millimeters in depth.

The natural consumables begin the filling process with mechanical grinding via a commercial grinder. A measured amount of natural consumables 44 is positioned loosely within filling tray 201 and manipulated so that they drop through the holes of the filling tray into the flower cartridges. The operator may use any mechanical means, such as a brush, spatula, spreader, or scraper, to facilitate movement of consumables through the holes of the filling tray into the empty flower cartridges below, including tilting or shaking the filling assembly by hand. The process may be accelerated and settling of the consumables promoted by vibrating the assembly via vibrating table 210. The power of the vibrating table may be adjusted to ensure the consumables settle and are evenly distributed throughout. The filling process is considered complete when all tubes have been filled to a level flush with the surface of the filling tray 201.

The plant matter and/or whole flower is ground at a preferred humidity and moisture content. Oxidation of the active ingredients when the natural consumables are exposed to air is expected and can change the efficacy of the natural consumables. The filling process, by compressing consumables into a porous plug, mitigates oxidation and degradation by reducing the open surface area of the material, thereby reducing the oxidation and evaporation rate of the contents and helps preserve the shelf life of the filled cartridge. In an exemplary embodiment, 62.5 grams of natural consumables is placed upon the filling tray for even distribution into 500 flower cartridges to achieve a per cartridge fill mass of 0.125 g.

Figure 9D:
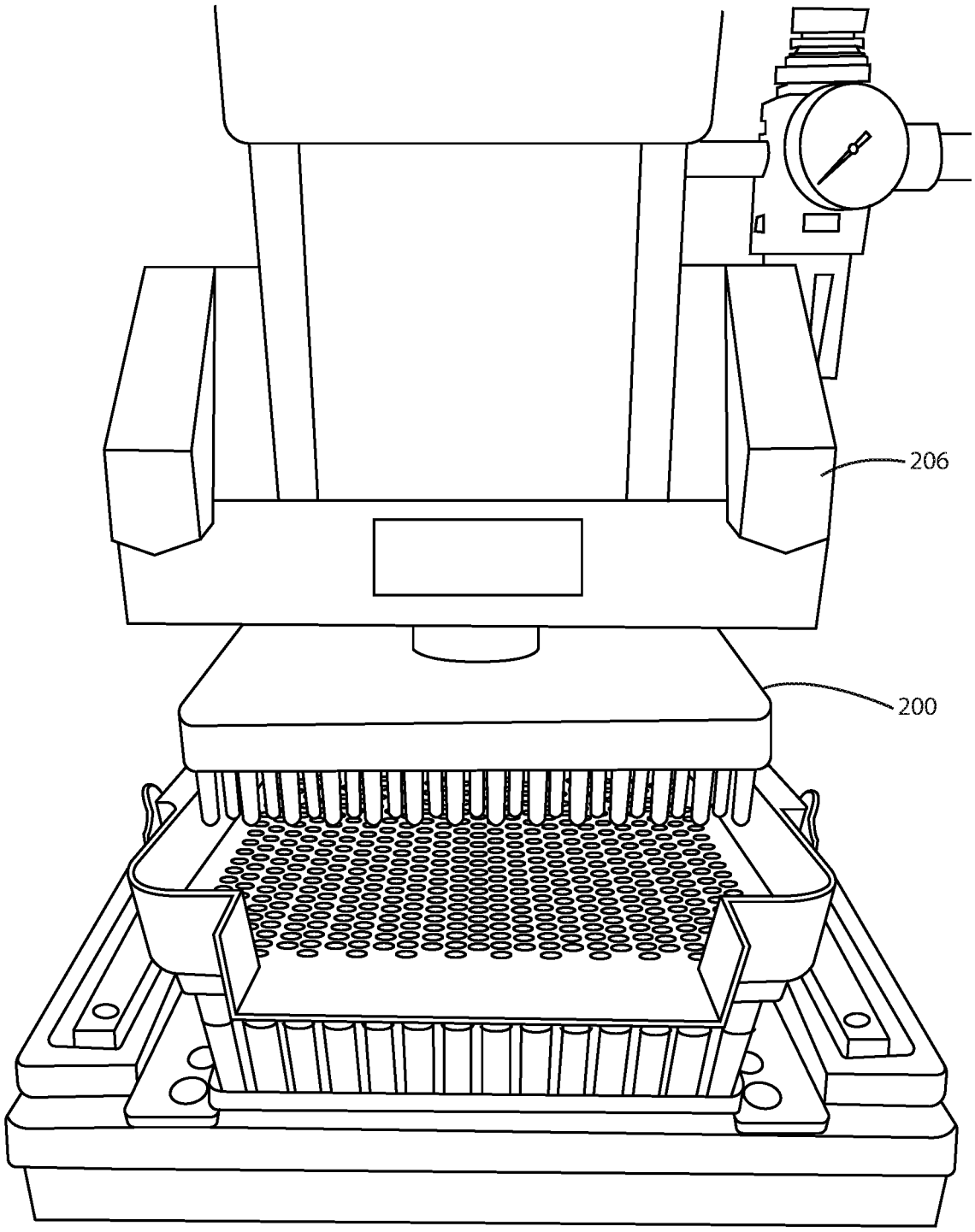
FIG. 9D is an illustration of the filling assembly positioned at the press for tamping.

FIG. 9D shows the flower cartridge assembly about to be tamped. Once filling and vibration steps are complete, the assembly is positioned within the press 206 such that the individual protrusions of the tamping plate 200 are aligned with the individual holes of the filling tray 201. The press may be activated by pneumatic means to insert the tamping plate to a preconfigured depth. Tamping plates with protrusions of varying depths are expressly contemplated to match with filling trays of varying depths, or may be suitably adapted for use with natural consumables that have wide ranges of density, viscosity, or stickiness. In an exemplary embodiment, this depth will be flush with the insertion end of the flower cartridge.

The present invention contemplates a different mass or volume of consumables per cartridge, by varying the physical dimensions of the first or second tube, method of crimping, tamping pressure, or tamping depth. The variations described are aimed at creating a porous plug within the cartridge of a predetermined density and volume to deliver a precise amount of active ingredients and a predictable, high quality user experience.

Figure 10A:
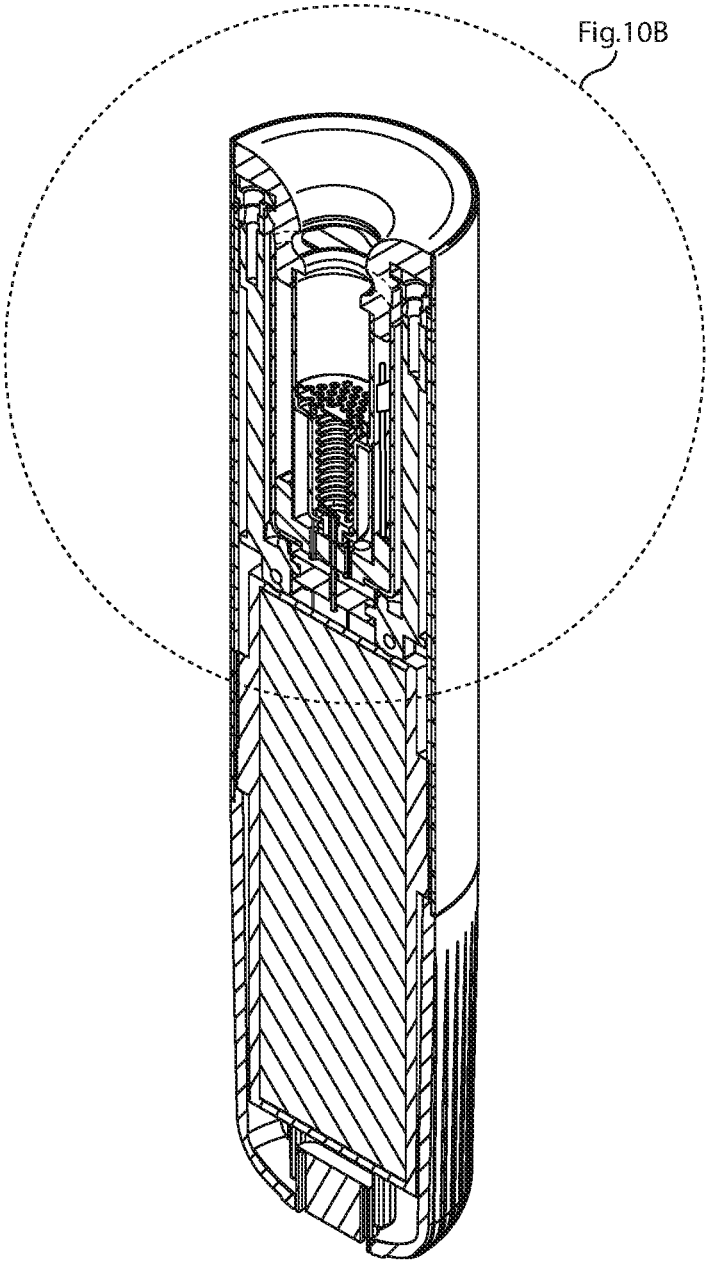
FIG. 10A is a perspective cross-sectional view of a heating device for use with a cartridge.
Figure 10B:
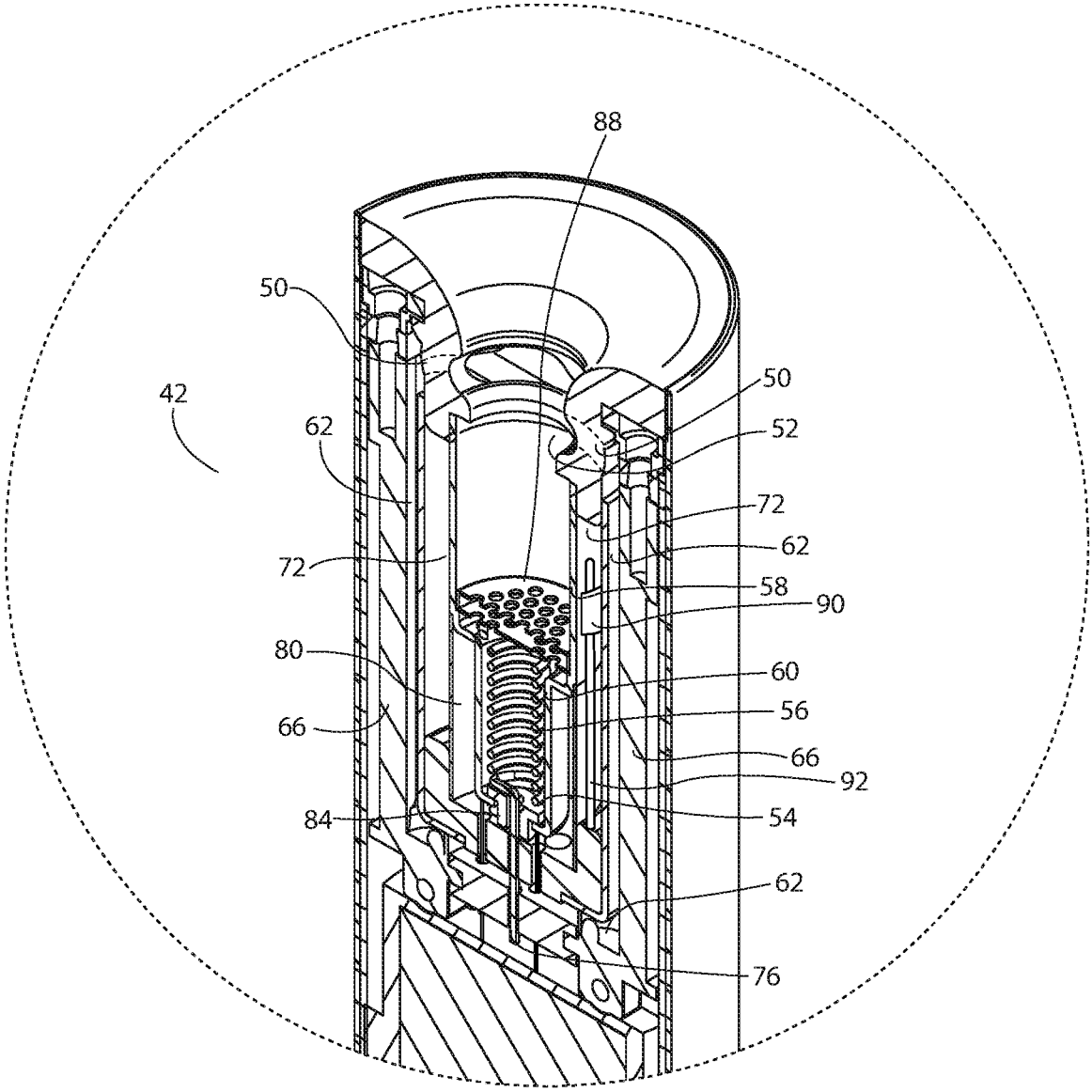
FIG. 10B is an exploded view of a heating device for use with a cartridge.
Figure 10C:
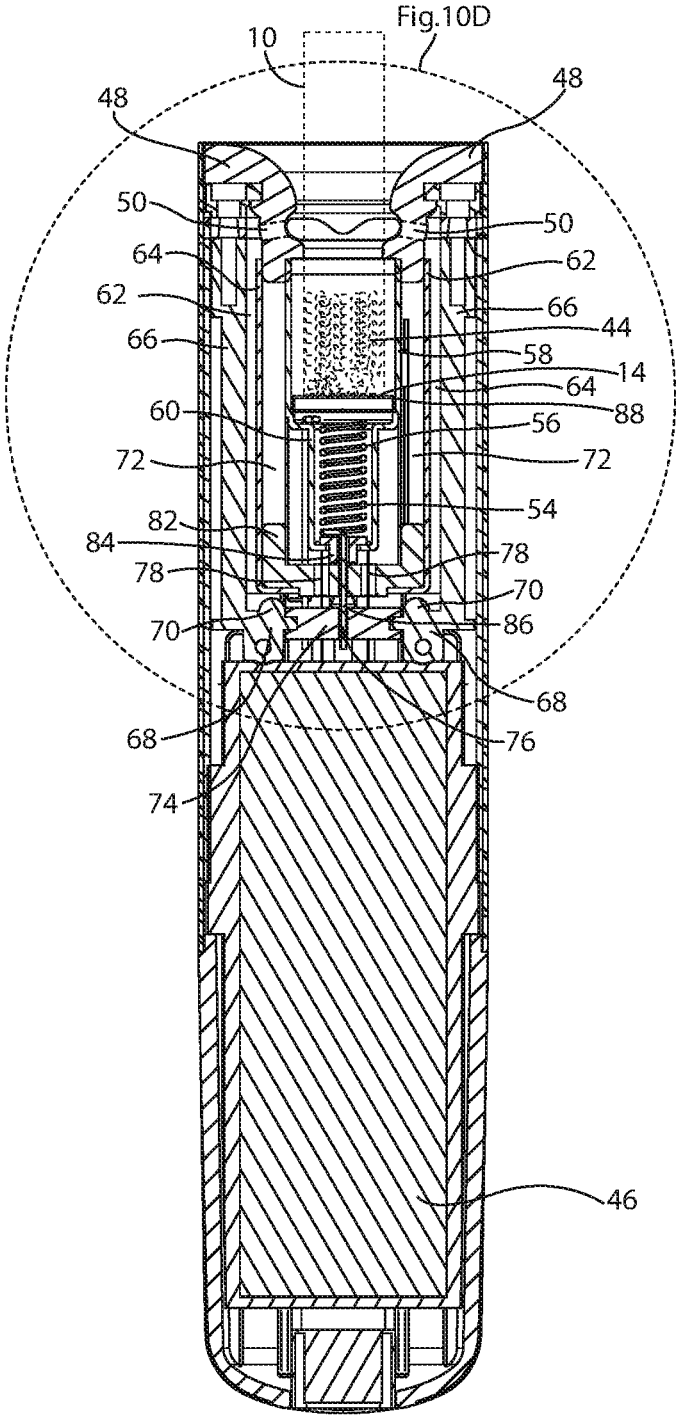
FIG. 10C is a cross-sectional view of a heating device with an inserted cartridge.
Figure 10D:
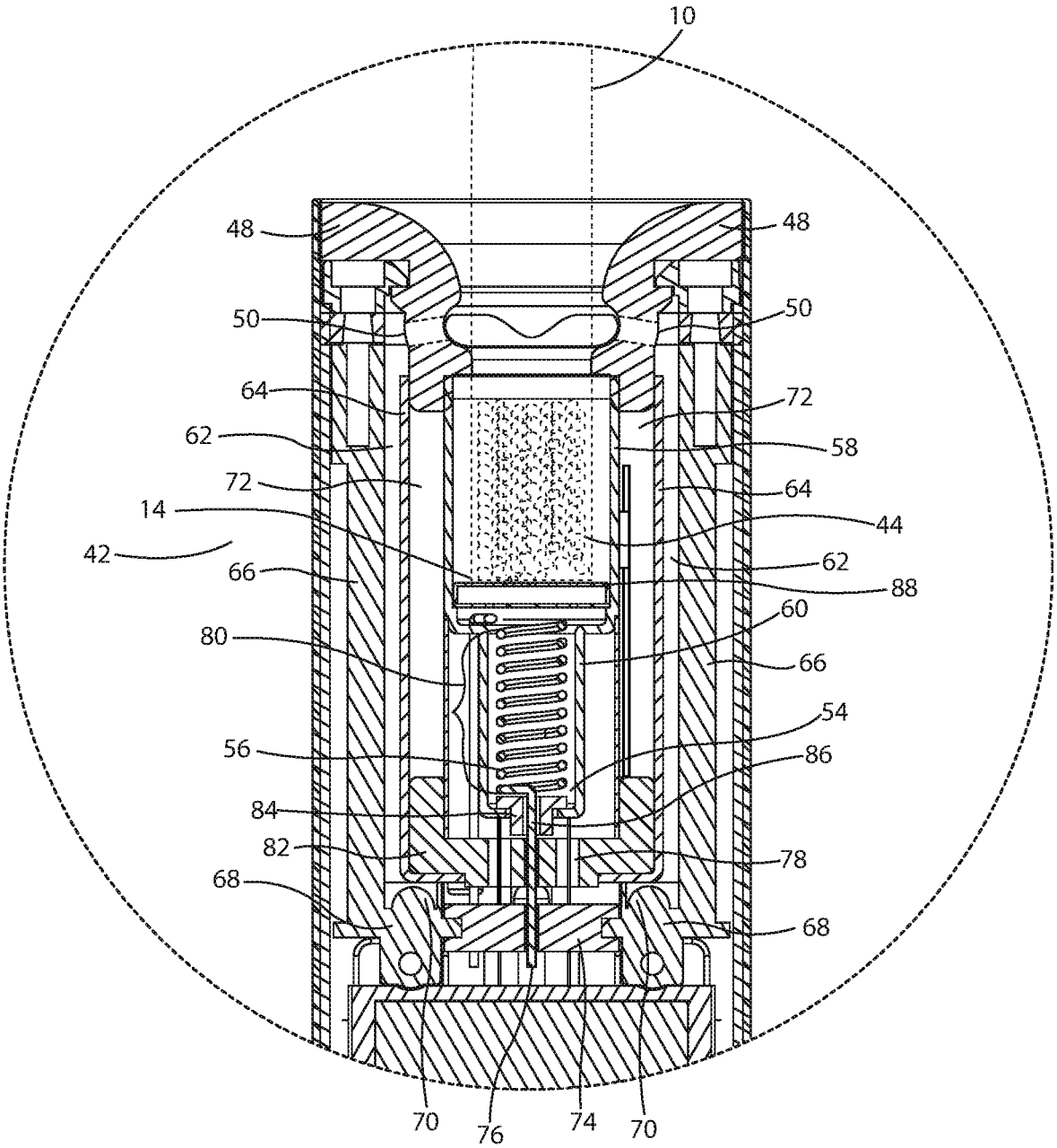
FIG. 10D is a detail view of a cross-sectional view of a heating device with an inserted cartridge.

FIGS. 10A-10D depict various embodiments of the heating device 42. The heating device 42 is constructed from aluminum tubing and is adapted for use with a flower cartridge 10, which is detachable and disposable. The heating device 42 heats air by electrical energy stored in a battery 46 passed by pulse modulation to an oven assembly 54. FIG. 10B shows a sealing ring 48 surrounds the cartridge insertion aperture 52. The sealing ring 48 is affixed to the oven housing 60. In an embodiment of the cartridge 10 depicted in for example FIG. 1B, a tolerance fit may be formed between the sealing ring 48 and the first tube 12, thereby holding the cartridge 10 in place. In the embodiment of the cartridge 40 shown in FIG. 7F, the sealing ring 48 may form a tolerance fit with the single tube 30. As shown in FIG. 10C, the sealing ring 48 surrounds a cartridge 10 that has been inserted through the cartridge insertion aperture 52 into the cartridge chamber 58. Air current movement is generated by user inhalation. Air is drawn from the outside and passes between the sealing ring 40 and the inserted cartridge 10 into bilateral air inlet chambers 62 via air inlets 50 in the sealing ring 48. Air is heated as it enters the oven assembly 54 and oven 56. Upon entering the cartridge chamber 58, the heated air enters the insertion end 34 of the cartridge 10 and heats the filled consumables 44 therein using heat-not-burn convection technology. The heated consumables 44 release desired chemicals at specific temperature profiles into the inhaled vapor.

The cartridge chamber 58 is constructed of multiple metal shims that act to both heat ambient air and prevent consumables 44 from falling directly into the oven assembly 54 and oven 56. The heating device 42 is constructed so as to prevent hot air blowback and accidental vent blockage by the user.

Ambient air flows bilaterally from the outside the heating device 42 through air inlets 50 in the sealing ring 48 into bilateral air inlet chambers 62 running along a longitudinal axis, away from the air inlets 50. The bilateral air inlet chambers 62 are disposed between the inner oven housing wall 64 and the outer oven housing wall 66 and extend longitudinally proximate the air inlets 50 to the oven housing base 68. This arrangement passes incoming cold air against the walls of the device and acts to cool the device each time the user draws through the cartridge 10. The inner oven housing wall 64 and the outer oven housing wall 66 provide lateral stabilization to the air inlet chambers 62 and insulation from the heat generated in the oven 56. Support fins 70 positioned beneath the oven housing base 68 provide longitudinal stabilization to the oven assembly 54 and the oven housing 60. Bilateral insulation 72 extends longitudinally between the outer oven housing wall 66 and the inner oven housing wall 64, thereby further insulating the air inlet chambers 62 from the heat emanating from the oven assembly 54.

As shown in FIG. 10D, a silicon housing base seal 74 disposed in the oven housing base 68 serves to insulate the heater wires 76 that power the oven 56 by way of a battery 46. Temperature sensor 90 detects the temperature of the oven assembly 54 and the signal is passed to the internal electronics via sensor wires 92. At the oven housing base 68, the bilateral air inlet chambers 62 extend medially toward heat channels 78 which are disposed in an oven assembly seal 82. The heated air enters an air uptake portal 86 in a ceramic insulator 84 disposed at the distal end of the oven housing 60. The air passes over the heat coils 80 in the oven assembly 54 and is heated. The air then rises through layered aperture arrays 88 at the distal end of the cartridge chamber 58, as shown in FIG. 10B. The heated air then enters through the insertion end 34 of the cartridge 10 by convective heat transfer, thereby heating the consumables 44.

Figure 10E:
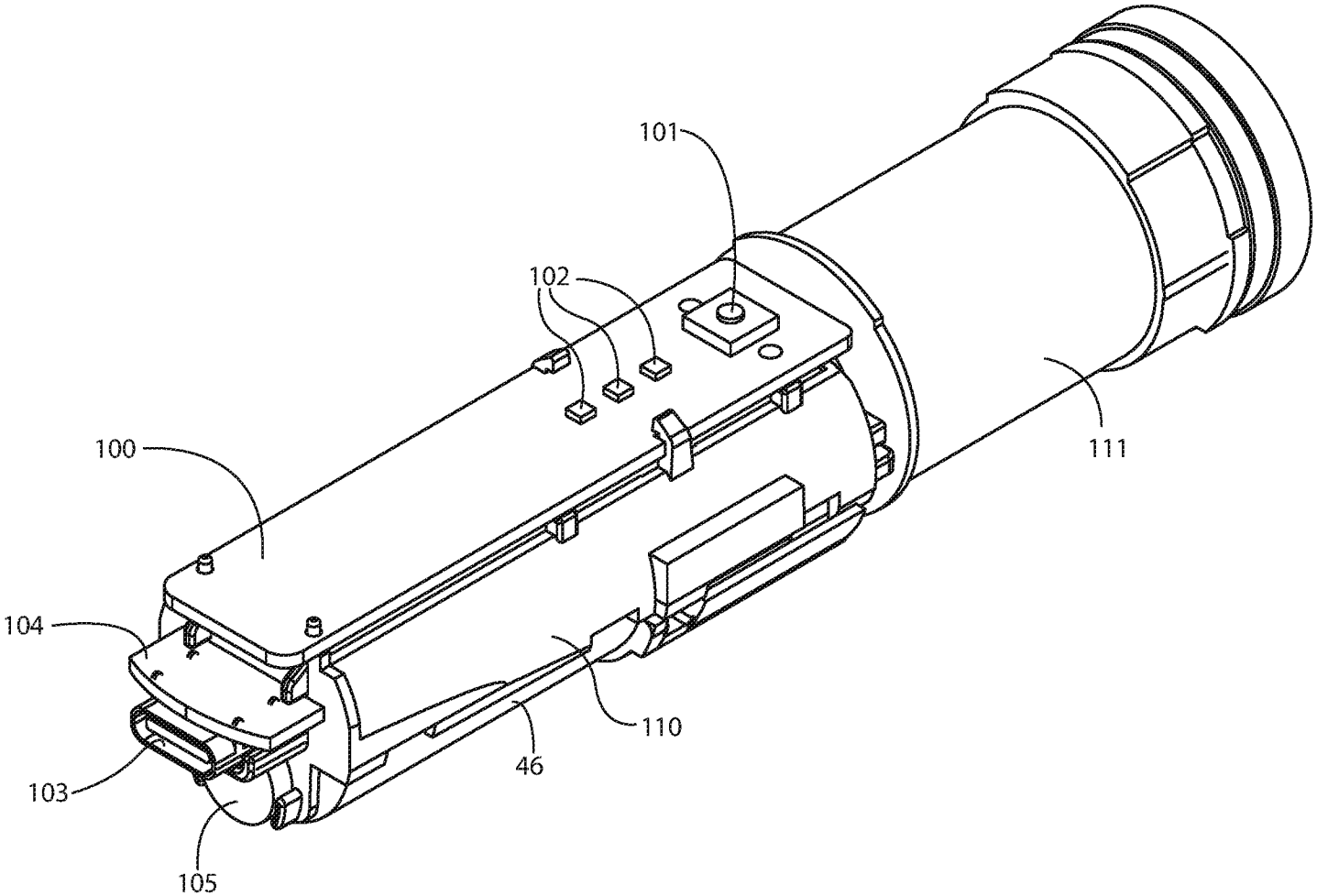

FIG. 10E is a profile view of the major electronic components of the heating device as assembled. These electronic components comprise circuit board 100, power button assembly 101, LED indicators 102, USB port 103, charging circuit board 104, tactile feedback motor 105, and battery 46.

The electronic components are housed by and/or attached structural element 110 and electrically connected to the oven assembly 54 housed in structural element 111.

Figure 10F:
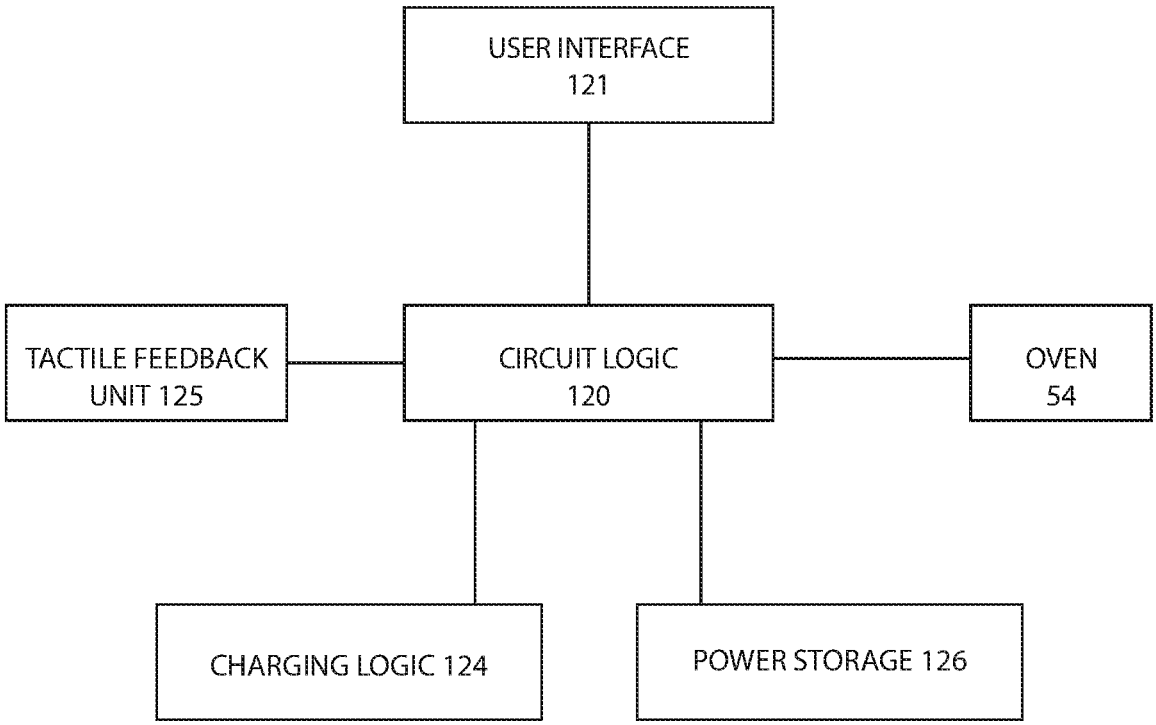

FIG. 10F is a block diagram of the electronic logic. The device is controlled via a circuit logic 120 implemented by electronic components such as integrated circuits and processing means located on circuit board 100. A user interface 121, which may be implemented by power button assembly 101 and LED indicators 102, is connected to the circuit logic. A tactile feedback unit 125 is connected to the circuit logic and provides tactile feedback based on device operation and may be implemented via tactile feedback motor 105. Power storage 126 provides power to the circuit logic, which in one embodiment is implemented via battery 46, and charging of the device is controlled by charging logic 124 which may be implemented via a USB port 103 and charging circuit board 104.

The circuit logic controls oven assembly 54 via power means, which may be implemented by heater wires 76, and temperature sensing means, which may be implemented by temperature sensor 90 and sensor wires 92. In an exemplary embodiment, heating power is provided by pulse modulated current at 180 Hz frequency. Temperature feedback information provided by sensor 90 is sampled at up to 20 kHz and returned to the circuit board as an analog signal.

LED indicators 102 comprise of a number of individual LED lights. In an exemplary embodiment, three (3) LED lights signal various device events and conditions, such as battery state, charging state, warm-up wait time, and consuming session information. These are achieved by turning the LEDs on or off in a sequential manner, of increasing or decreasing frequency, and brightening and fading them within a timeframe. In an exemplary embodiment, all 3 LEDs may be turned on to indicate the start of a session (when warmup is complete) and gradually dim and turn off one by one as the session progresses. In a charging state, the LEDs may flash and remain lit to indicate battery level.

The device provides tactile feedback to the user by a motor 105 which causes the device to vibrate. Different types of vibration are contemplated to provide different feedback. For example, the strength of a vibration may be adjusted from a baseline level such as a vibration of increasing strength (to signal device on) or a vibration of decreasing strength (to signal device off). Such feedback may also be provided to notify users of session start (when warmup is complete) and session end (where device enters sleep mode). Sequences in vibrations, a strong vibration followed by a weaker vibration, or vice versa, are used to indicate other device status such as an error state. Device events may also be reported via a combination of visual (LED) and tactile indicators.

The heating device begins its operation in sleep mode. An application of charging voltage via USB port may wake-up the device and cause it to enter charging mode, of which after completion the device returns to sleep mode. User action (by depressing and holding power button) may also initiate a wake-up. The device checks for charging voltage and also displays the battery level via the LED indicators 102. If the length of the button press exceeds a certain threshold, the device performs a safety check and if a failure is detected, the system will provide tactile feedback and re-enter sleep mode.

If safety checks are passed, the device enters warm-up mode and maintain mode according to a temperature profile. During this phase, the user may depress the button and cause the device to re-enter sleep mode. In the warm-up mode, the device applies high input power to bring the oven to a target temperature in a short time and notifies the user to begin the session by visual and tactile feedback. In the maintain mode, the device adjusts input power to maintain a target temperature or to gradually change the temperature of the oven. The device adjusts the temperature of the session via the temperature profile, which is pre-programmed into the circuit logic. In an exemplary embodiment, the temperature is maintained within 10° F. (6° C.) of the preset temperature.

Figure 10G:
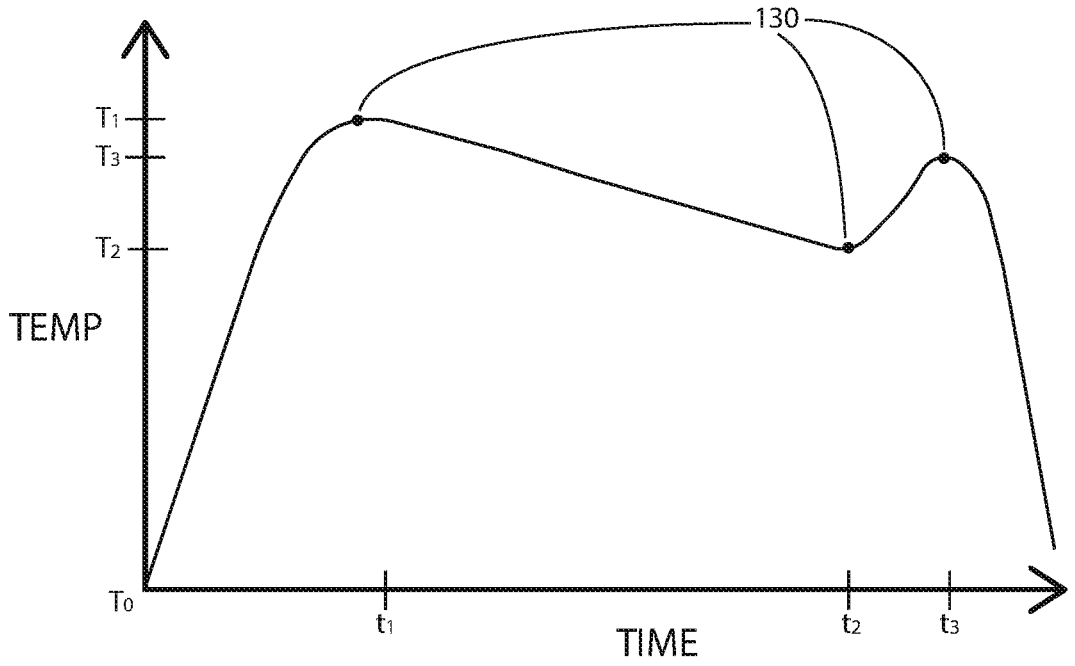

FIG. 10G shows a temperature profile graph during an exemplary session. The graph shows the temperature of the oven as a function of time, and such a profile may be programmed into the electronics. The graph may contain several inflection points 130 where a change in heating or cooling is expected. At the initiation of a session (t0), the device rapidly preheats to target temperature T1 at a time t1 where the consuming session begins for the user. The oven then slowly cools and the heat applied reduced as the natural consumables' properties change during a session, such as when the humidity changes. Such a cooling may be sustained until temperature T2 and time t2 where heat is again applied to increase the temperature of the oven to another peak at T3, thereby giving the user a "hot feel" designed to simulate the conclusion of a consumption experience.

In an exemplary embodiment, temperature ranges for the oven are an initial heat-up to 400-440° F. ($T_1$) (204-227° C.) where time ($t_1$) from power-up (to) is variable depending on environmental factors, but usually within about 30 seconds; a temperature as low as 300° F. ($T_2$) (149° C.) at time ($t_2$) of 160 seconds from power-up; and a temperature of up to 450° F. ($T_3$) (232° C.) at a time ($t_3$) of 180 seconds from power-up, before cooling to ambient temperature post $t_3$. The device is adapted to maintain temperature ranges within 10° F. (6° C.). In the exemplary embodiment, the electronics senses the temperature feedback from the oven and the cartridge, preventing both from reaching combustible temperatures, thereby reducing the risk of actual burning of the cartridge or fire.

Figure 10H:
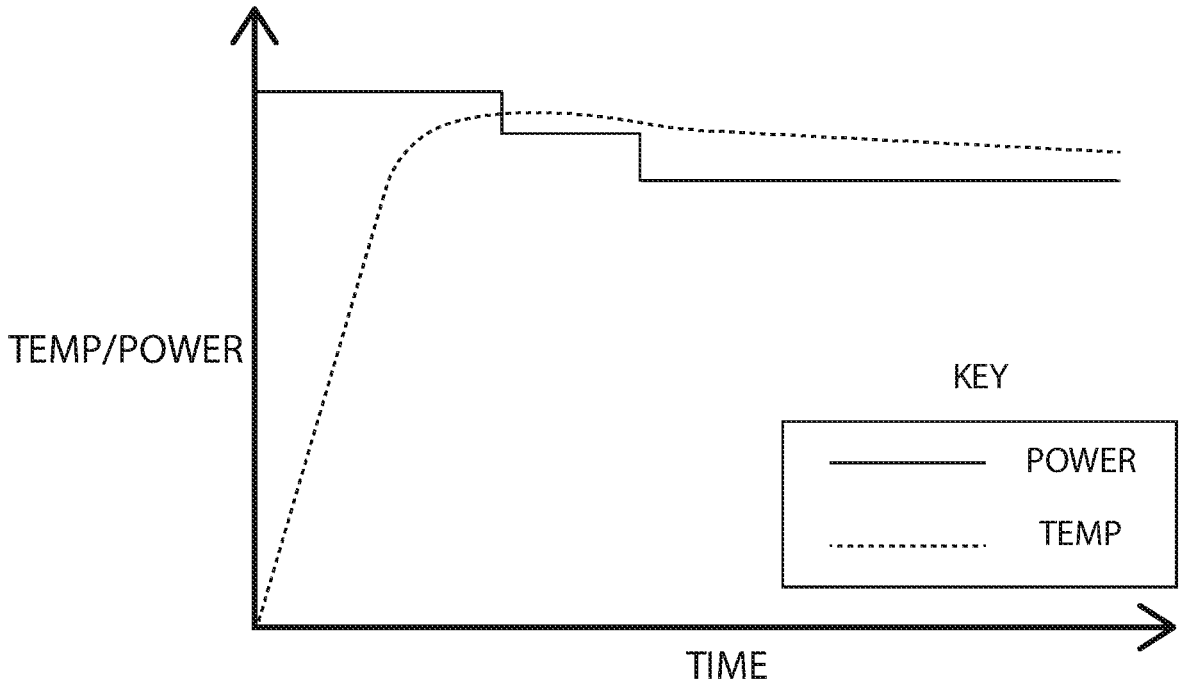

FIG. 10H shows a temperature profile overlaid with a power application graph. Here it is observed that the power applied to the oven begins at the max setting to bring the oven to a preheated state and is reduced as the session progresses, reaching a steady-state of a preset temperature. No "hot feel" is programmed in the exemplary temperature profile.

Figure 10J:
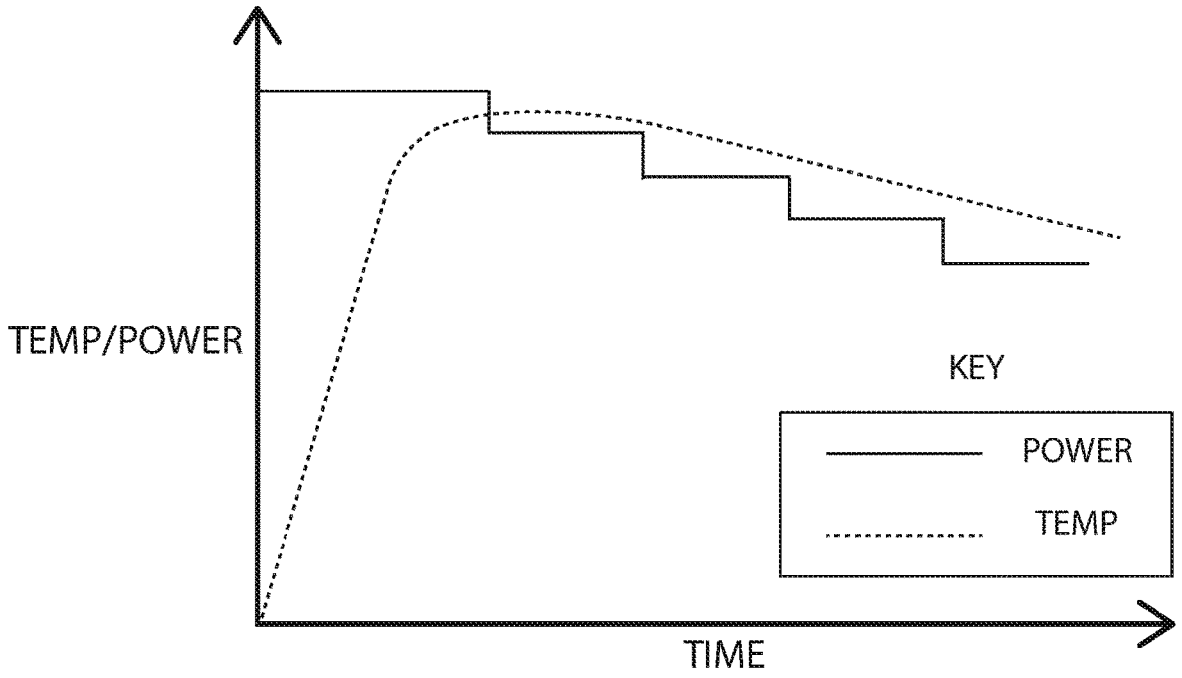

FIG. 10J shows another a temperature profile overlaid with a power application graph. Here it is observed that the power applied to the oven begins at the max setting to bring the oven to a preheated state and a sharper reduction in power than in FIG. 10H, corresponding to a reduction in oven heat, is contemplated.

Figure 10K:
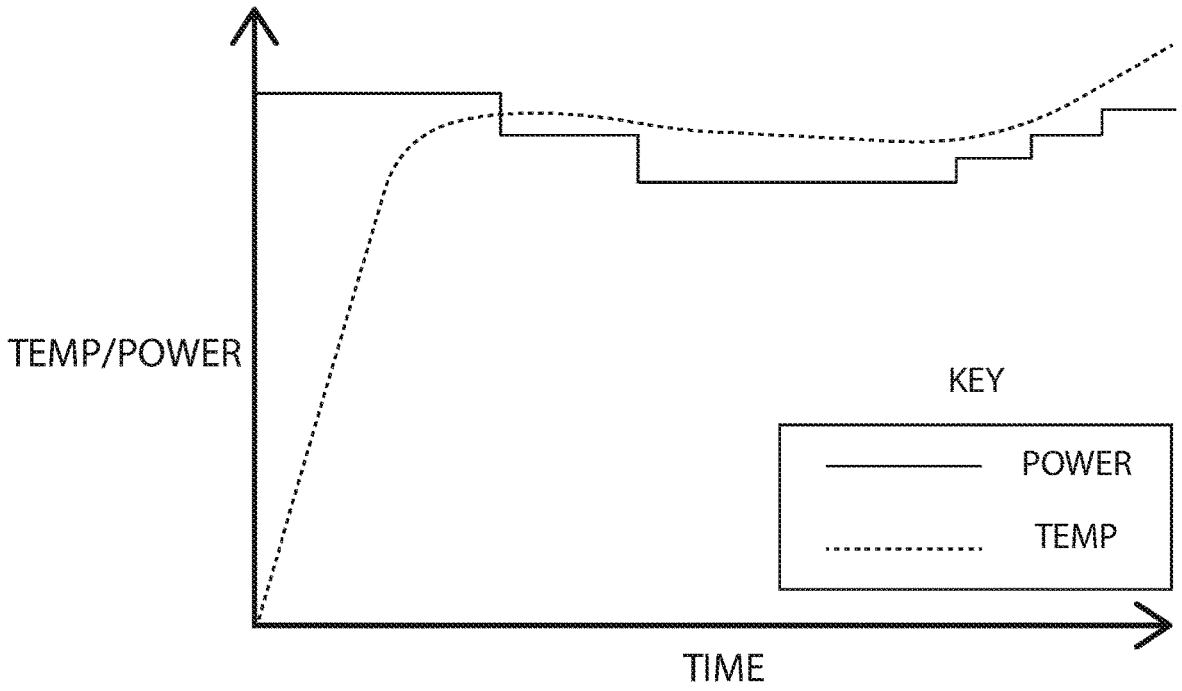

FIG. 10K shows another a temperature profile overlaid with a power application graph. Here it is observed that the power applied to the oven begins at the max setting to bring the oven to a preheated state and gradually trails off as the session progresses, and at the end the power is increased again for a "hot feel."

All publications and patent applications cited in this specification are herein incorporated by reference as if each individual publication or patent application were specifically, and individually, indicated to be incorporated by reference.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A method of uniformly filling natural consumables into flower cartridges for use with a heat-not-burn heating device, comprising:

loading a plurality of flower cartridges within a cartridge tray assembly;

forming a filling assembly by positioning the cartridge tray assembly beneath a filling tray;

placing a quantity of natural consumables in the filling tray;

distributing the natural consumables into a plurality of openings of the filling tray;

forming a tamping assembly by placing the filling assembly into a press with a tamping plate;

operating the press so that the tamping plate is pressed into the filling assembly for a predetermined depth, after which the plate is retracted;

removing the cartridge tray assembly from the tamping assembly;

disassembling the cartridge tray assembly to permit unloading of the plurality of flower cartridges;

wherein the tamping plate is configured to compress the natural consumables to a uniform density within the flower cartridges;

wherein the plurality of flower cartridges to be filled are stacked within the cartridge tray assembly such that each cartridge is in contact with at least one other cartridge;

wherein contacting cartridges are held in a position by compressive forces exerted by the cartridge tray assembly from each side of the assembly facing the walls of the cartridges; and wherein the position in which the contacting cartridges are held aligns the openings in the filling tray with the openings of the cartridges.

2. The method of claim 1, wherein positioning the cartridge tray assembly further comprises aligning the openings of each flower cartridge with each opening of the filling tray.

3. The method of claim 1, wherein forming a filling assembly further comprises positioning the cartridge tray assembly above a base plate.

4. The method of claim 1, wherein the step of distributing includes physical spreading, scraping, or smoothing by spatula, brush, or scraper.

5. The method of claim 1, wherein the step of distributing includes tilting or agitating the filling assembly.

6. The method of claim 1, wherein the step of distributing further comprises filling the natural consumables to a level flush with the surface of the filling tray and removing any excess from the tray.

7. The method of claim 1, wherein the press is pneumatically powered.

8. The method of claim 1, wherein the sides of the cartridge tray assembly are contoured to snugly fit the shape of the stacked cartridges.

9. The method of claim 1, wherein the plurality of flower cartridges within the cartridge tray assembly is stacked in a tessellated fashion.

10. The method of claim 1, wherein the filling tray comprises a raised or flared rim, configured to receive a quantity of natural consumables and retain the consumables within the tray during application of mechanical means.

11. The method of claim 1, wherein the depth of the openings of the filling tray are selected based on the density, viscosity, or stickiness of the natural consumables.

12. The method of claim 1, wherein the step of distributing includes applying vibration to the filling assembly via a vibration table.

13. The method of claim 12, wherein the step of applying vibration further comprises applying vibrations of varying power levels to the filling assembly until the natural consumables settle to a level flush with the surface of the filling tray.

14. The method of claim 1, wherein the tamping plate comprises a plurality of protrusions that are adapted to fit into the openings of the filling tray.

15. The method of claim 14, wherein each protrusion is immobile in relation to one another and the plurality of protrusions are configured to move in unison.

16. The method of claim 14, wherein each flower cartridge further comprises an insertion end adapted to receive natural consumables; and wherein the length of the protrusions of the tamping plate and the depth of the openings of the filling tray are configured to compress the natural consumables to a level flush with the insertion end of the flower cartridge.

17. The method of claim 14, additionally comprising positioning the filling assembly by aligning the plurality of protrusions of the tamping plate with the plurality of openings of the filling plate.

18. The method of claim 14, wherein the depth of the openings of the filling tray are variable.

19. The method of claim 18, wherein the depth of the openings of the filling tray are selected based on the density, viscosity, or stickiness of the natural consumables.

20. The method of claim 1, wherein operating the press further comprises applying sufficient force to the natural consumables within the tamping assembly that such consumables form a porous plug held together by compressive forces while allowing air to pass through the plug.

21. The method of claim 20, wherein the porous plug disposed within the flower cartridge is configured to reduce the oxidation and evaporation rate of the active ingredients of the natural consumables.

22. A tamping assembly for uniformly filling natural consumables into flower cartridges for use with a heat-not-burn heating device, comprising:

a tamping plate;

a filling tray with a plurality of openings;

a cartridge tray assembly;

a base plate;

wherein the cartridge tray assembly is configured to hold the plurality of flower cartridges to be filled such that each cartridge is in contact with at least one other cartridge and the contacting cartridges are held in a position by compressive forces exerted by the cartridge tray assembly from each side of the assembly facing the walls of the cartridges; and wherein the position in which the contacting cartridges are held aligns the openings in the filling tray with the openings of the cartridges.

23. The tamping assembly of claim 22, wherein sides of the cartridge tray assembly are contoured to have indentations that receive individual cartridges of the plurality of flower cartridges at specific positions so that the contacting cartridges are held in alignment with the openings in the filling tray.

* * * * *